US008714462B1

(12) United States Patent
Bedford et al.

(10) Patent No.: US 8,714,462 B1
(45) Date of Patent: May 6, 2014

(54) SPECIAL TRACK ASSEMBLY AND METHODS OF MAKING SAME

(75) Inventors: W. Bradley Bedford, Guelph (CA); John G. Brooks, Kitchener (CA); Bruce E. Burkhardt, Conestogo (CA); Richard Ellis, Kitchener (CA)

(73) Assignee: Polycorp Ltd., Ontario (CA)

( * ) Notice: Subject to any disclaimer, the term of this patent is extended or adjusted under 35 U.S.C. 154(b) by 754 days.

(21) Appl. No.: 12/500,200

(22) Filed: Jul. 9, 2009

Related U.S. Application Data

(60) Provisional application No. 61/079,144, filed on Jul. 9, 2008.

(51) Int. Cl.
*E01B 5/00* (2006.01)

(52) U.S. Cl.
USPC ..... 238/122

(58) Field of Classification Search
USPC ..... 238/2, 3, 8, 9, 14.05, 14.3, 122, 151, 238/152, 264–266, 280, 283
See application file for complete search history.

(56) References Cited

U.S. PATENT DOCUMENTS

| | | | | |
|---|---|---|---|---|
| 2,670,136 | A | 2/1954 | Moses | |
| 3,344,990 | A | 10/1967 | Bingmann et al. | |
| 3,525,472 | A | 8/1970 | Sato | |
| 3,755,670 | A * | 8/1973 | Damy | 246/468 |
| 3,837,948 | A | 9/1974 | Nelson et al. | |
| 4,239,156 | A | 12/1980 | Skinner et al. | |
| 4,365,743 | A * | 12/1982 | Trickel et al. | 238/8 |
| 4,386,736 | A | 6/1983 | Benkler et al. | |
| 5,160,084 | A * | 11/1992 | Owen et al. | 238/310 |
| 5,503,331 | A | 4/1996 | Uramson, Jr. et al. | |
| 5,609,294 | A * | 3/1997 | Lucas, Jr. | 238/9 |
| 5,622,312 | A | 4/1997 | Martin | |
| 6,129,288 | A | 10/2000 | Petersen et al. | |
| 6,230,981 | B1 | 5/2001 | Hill et al. | |
| 6,296,195 | B1 | 10/2001 | Blank et al. | |
| 6,402,044 | B1 * | 6/2002 | Sato | 238/382 |
| 6,471,138 | B1 | 10/2002 | Blank et al. | |
| 6,726,116 | B2 | 4/2004 | Hofstetter, Sr. | |
| 7,484,669 | B2 | 2/2009 | Gray, Jr. | |
| 7,556,209 | B2 | 7/2009 | Sears | |
| 2005/0023366 | A1 | 2/2005 | Williams et al. | |
| 2011/0084175 | A1 | 4/2011 | Naquin | |

* cited by examiner

*Primary Examiner* — R. J. McCarry, Jr.
(74) *Attorney, Agent, or Firm* — Carlson, Gaskey & Olds P.C.

(57) ABSTRACT

A method of making a special track assembly for supporting a train, including providing a special track segment, and attaching a number of ribs made of a resilient material to exterior surfaces of the special track segment. Adjacent ones of the ribs are spaced apart from each other by predetermined distances to define gaps therebetween respectively. The method also includes attaching one or more wall portions of the resilient material to the ribs, for bridging each gap to at least partially define a number of cavities between the adjacent ribs respectively. Each wall portion is deflectable for dissipating energy transmitted by movement of the special track segment relative to the supporting material which supports the special track assembly.

22 Claims, 25 Drawing Sheets

SPECIAL TRACK ASSEMBLY AND METHODS OF MAKING SAME

This application claims the benefit of U.S. Provisional Application No. 61/079,144, filed Jul. 9, 2008, the entire contents of which prior application are hereby incorporated herein by reference.

FIELD OF THE INVENTION

This invention is related to a special track assembly for supporting a train.

BACKGROUND OF THE INVENTION

At intersections of municipal railway track (e.g., for streetcars), various types of rails known as "special track" are required. For example, the special track may be designed to enable two substantially straight tracks to intersect (i.e., the special track may be a frog), or to provide curved track around a street corner, i.e., to guide the streetcar from one street to another. The special track may include switches. Segments of special track often are cast specifically for a particular intersection. As is known, the segments typically are attached to other segments of special track (or to straight track connecting with the special track) by means of fish plates or joint bars.

In the prior art, the special track typically is attached to cross ties so that the track is properly located, and concrete is then backfilled around the track, to cover the railway ties and to provide a generally level area in the intersection, i.e., between the rails and on both sides of the track. As is known, the cross ties may be made of various materials. Typically, if cross ties are used, they are positioned directly on concrete or embedded in concrete. In the prior art, track also may be positioned or embedded in concrete, i.e., in the absence of cross ties.

However, the prior art special track has a number of deficiencies. First, the prior art special track generates noise when a streetcar or train passes over it. The noise is generated by vibration of the special track as a streetcar or train passes over it, and often is a significant nuisance. Second, due to the stresses imposed on the concrete supporting the special track (and positioned beside and/or below the rails) as the streetcars or trains pass over the special track, the concrete often breaks, leading to other problems.

Finally, in many prior art municipal railways, current (i.e., "traction current") is passed through the track to complete the streetcar or train system's electrical circuit. However, stray currents may result from ground conditions, and these in turn can lead to other problems, e.g., arcing, which may result in accelerated corrosion of the rail.

SUMMARY OF THE INVENTION

For the reasons set out above, there is therefore a need for a special track assembly which addresses or mitigates one or more of the defects of the prior art.

In its broad aspect, the invention provides a method of making a special track assembly for supporting a train, the special track assembly being at least partially supportable by supporting material. The method includes providing a special track segment having one or more rail portions with a head for engaging wheels of the train with a number of top surfaces thereof, a foot securable to the supporting material, and a web connecting the head and the foot, and a body portion connected to the rail portion. The special track segment is at least partially defined by a number of exterior surfaces and the top surfaces thereof. The method also includes, next, attaching a number of ribs made of a resilient material to the exterior surfaces. Adjacent ones of the ribs are spaced apart from each other by predetermined distances to define gaps therebetween respectively. Subsequently, one or more wall portions made of the resilient material are attached to the ribs, for bridging each gap to at least partially define a number of cavities between the adjacent ribs respectively. Each wall portion is deflectable for dissipating energy transmitted by movement of the special track segment relative to the supporting material.

In another aspect, the ribs and the wall portion(s) are cured, to form the ribs and the wall portion(s) into a unitary covering adhering to the exterior surfaces for engagement with the supporting material.

In another of its aspects, the invention provides a method of making a special track assembly for supporting a train including, first, providing a special track segment, and second, forming a number of outer pockets including a second resilient material located in predetermined positions respectively relative to the exterior surfaces of the special track segment. Next, one or more molds is provided, each mold having one or more chambers for receiving a pourable material therein curable to form a resilient first material. Each at least one chamber is configured to form one or more wall portions made of the first resilient material at least partially enveloping the outer pockets. Each mold is positioned adjacent to the exterior surfaces of the special track segment. The pourable material is placed in the chamber. Subsequently, the pourable material is cured, to form the first resilient material therefrom for engagement with the supporting material, the wall portion and the outer pockets form a covering which is deflectable for dissipating energy transmitted by movement of the special track segment relative to the supporting material. Finally, the mold is removed.

In another aspect, the invention provides a special track assembly for supporting a train, the special track assembly being at least partially supportable by a supporting material and adapted for connection with one or more straight track portions each having a straight rail segment and a boot made of an electrically insulating material and partially covering the straight rail segment to define one or more exposed surfaces thereof. The special track assembly includes a special track segment. A rail portion of the special track segment is substantially alignable with a straight track portion upon respective ends of the rail portion and the straight track portion being positioned to abut each other. The assembly also includes a layer of an electrically insulating material attached to the exterior surfaces of the special track segment, for substantially electrically isolating the special track segment relative to the supporting material. Also, the assembly includes a connecting element for electrically connecting the special track segment and the straight rail segment, and a connecting portion made of the electrically insulating material for substantially electrically isolating at least the connecting element and an exposed surface of the straight rail segment relative to the supporting material.

In another of its aspects, the invention provides a special track assembly for supporting a train, the special track assembly being at least partially supportable by a supporting material. The special track assembly includes a special track segment and a covering including a layer of a first resilient material attached to the exterior surfaces of the special track segment. Also, the covering additionally includes a number of outer pockets in which a second resilient material is positioned, the outer pockets being configured so that the covering is deflectable for dissipating energy transmitted by movement of the special track segment relative to the supporting material.

BRIEF DESCRIPTION OF THE DRAWINGS

The invention will be better understood with reference to the attached drawings, in which.

DETAILED DESCRIPTION

Figure 1:
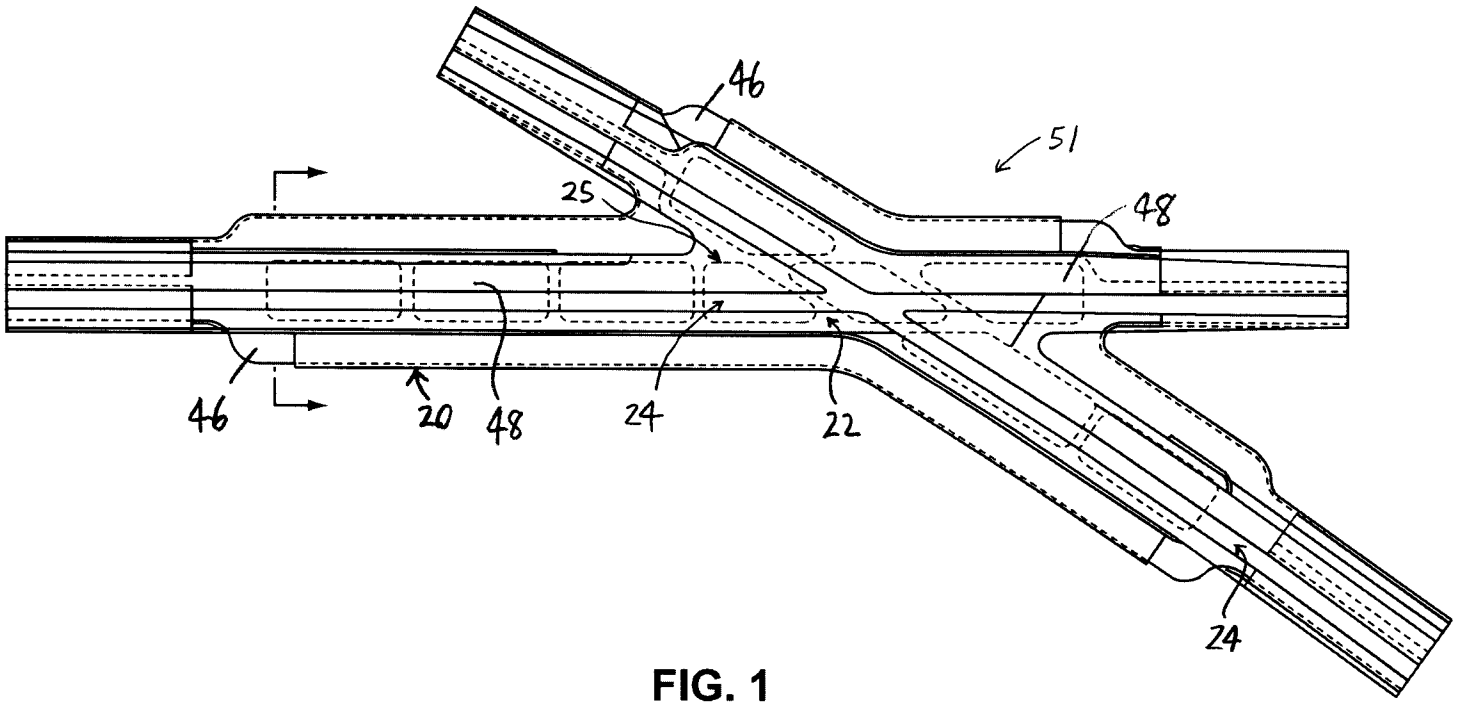
FIG. 1 is a top view of an embodiment of a special track assembly of the invention.

Reference is first made to FIGS. 1-8A to describe an embodiment of a special track assembly in accordance with the invention indicated generally by the numeral 51. The special track assembly 51 is for supporting a train (not shown), and is at least partially supported by a supporting material 26. The special track assembly 51 preferably includes a special track segment 22 which has one or more rail portions 24 and a body portion 25 connected to the rail portion 24. Preferably, the special track segment 22 is at least partially defined by a number of exterior surfaces 30 and a number of top surfaces 58 which are exposed when the special track assembly 51 is installed. In one embodiment, the assembly 51 includes a number of ribs 60 which are attached to the exterior surfaces 30, as will be described. Adjacent ribs 60 preferably are spaced apart by predetermined distances to define gaps 62 therebetween respectively. Preferably, the special track assembly 51 also includes one or more wall portions 36 attached to the ribs 60, for bridging the gaps 62 to at least partially define a number of cavities 64 between the adjacent ribs 60 respectively. It is also preferred that the wall portion 36 is deflectable for dissipating energy transmitted by movement of the special track segment 22 relative to the supporting material 26, as will also be described.

For the purposes hereof, "train" shall be understood to refer to any train, streetcar, or other device which travels on a track having two or more rails.

Figure 2A:
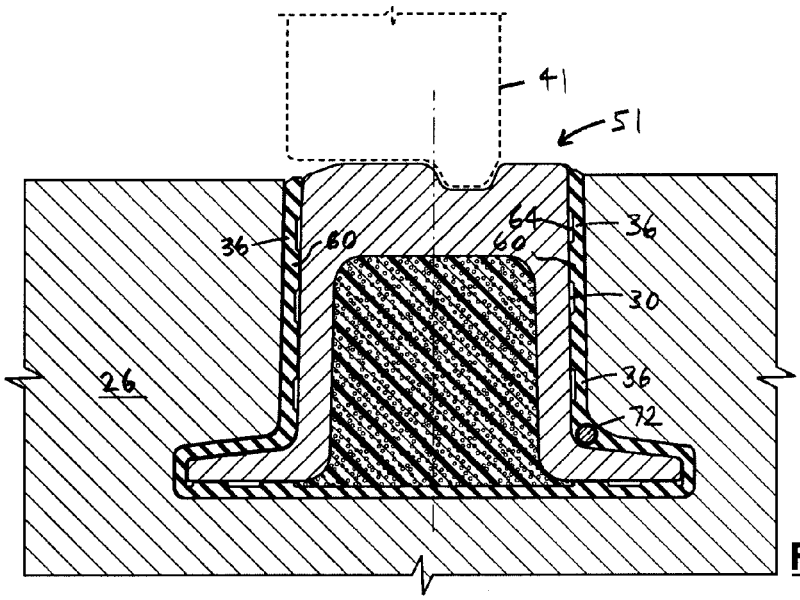
FIG. 2A is a cross-section of the special track assembly of FIG. 1 taken along line A-A in FIG. 1, drawn at a larger scale.
Figure 2B:
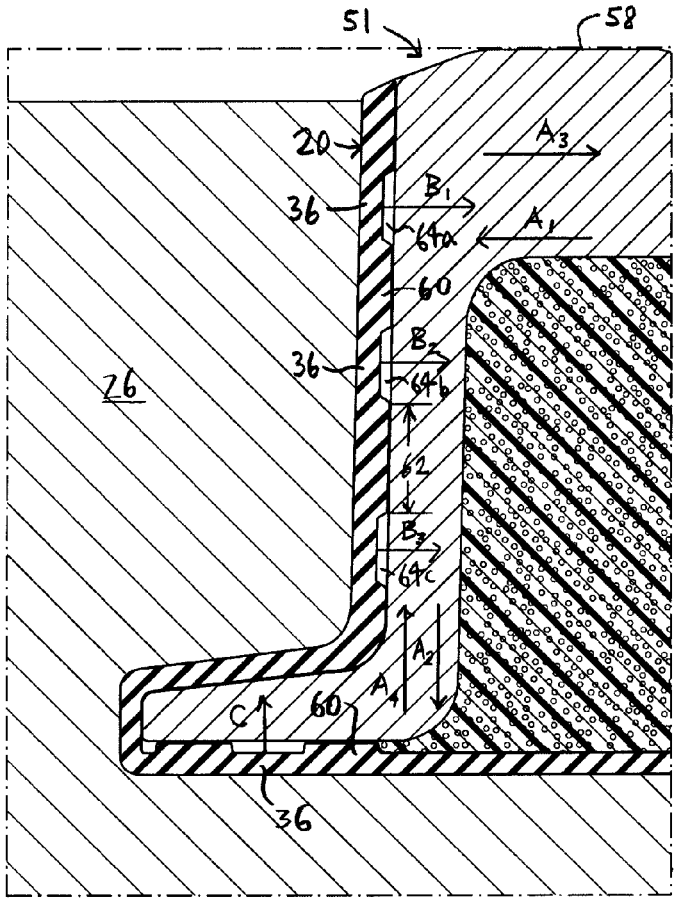
FIG. 2B is a cross-section of a portion of the special track of FIG. 2A, drawn at a larger scale.
Figure 3:
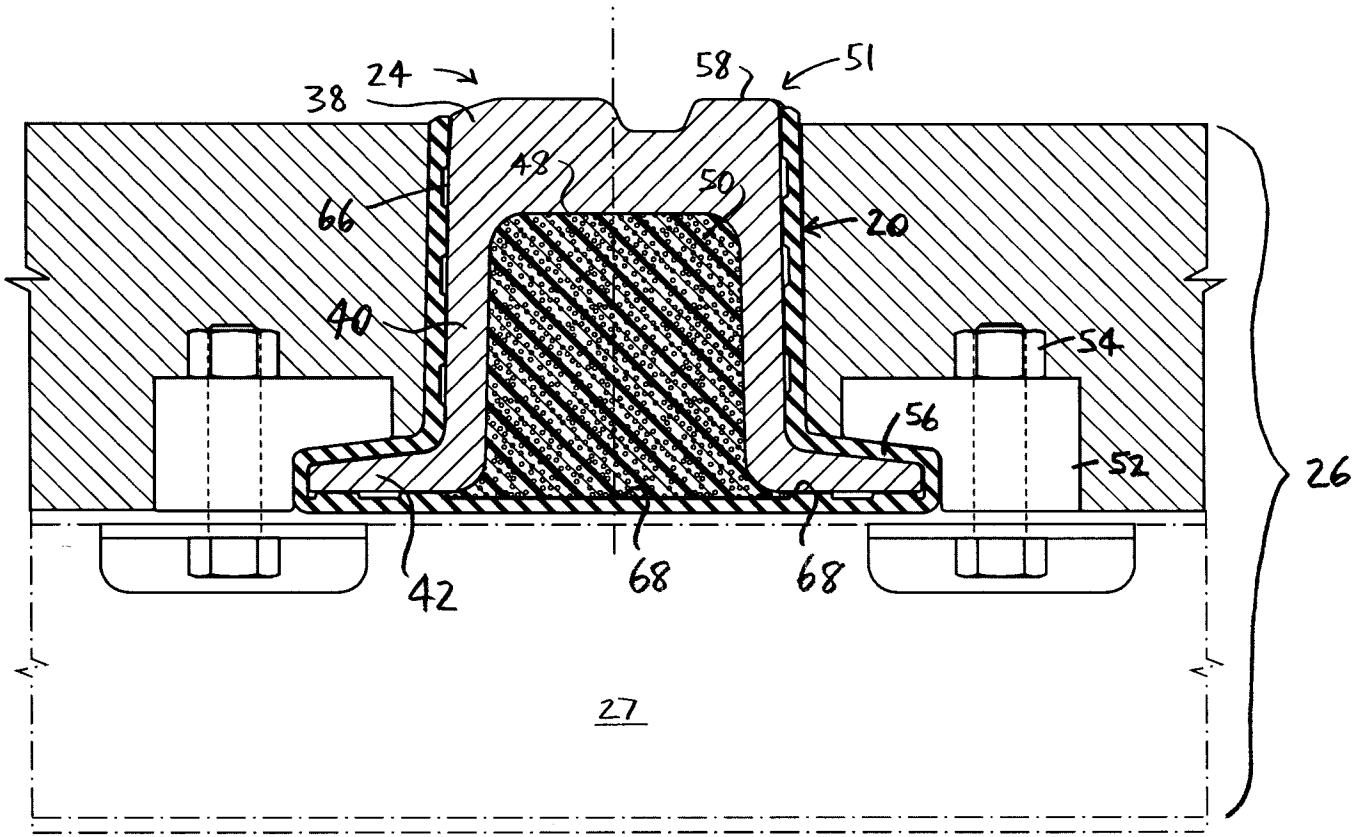
FIG. 3 is a cross-section of the special track assembly of FIG. 2A attached to a cross tie, drawn at a smaller scale.

As can be seen in FIGS. 2A-3, after its manufacture, the special track assembly is installed, where it is supported by the supporting material 26. The supporting material 26 may be any suitable material, as is known in the art. The supporting material 26 preferably is concrete. The supporting material 26 may include a base 27, e.g., a cross tie, to which the special track assembly 51 is attached.

Preferably, the wall portion 36 and the ribs 60 are made of a suitable resilient material, e.g., rubber. In one embodiment, it is preferred that the ribs 60 and the wall portion 36 are cured, to form the ribs 60 and the wall portion 36 into a unitary covering 20 adhering to the exterior surfaces.

As can be seen in FIG. 3, the rail portion 24 preferably includes a head 38 with top surfaces 58, certain of which surfaces are for engaging wheels 41 of the train (FIG. 2A). It is also preferred that the rail portion 24 includes a foot 42 securable to the supporting material 26, and a web 40 connecting the head 38 and the foot 42.

An exemplary configuration of a portion of the unitary covering or jacket 20 is shown in FIGS. 2A, 2B, and 3. As shown in FIG. 2B, the covering 20 preferably includes three cavities (identified as 64*a*, 64*b*, and 64*c* for convenience) which are positioned proximal to the head 38 and the web 40 of the rail portion 24. As shown in FIG. 2B, the covering 20 also includes an additional cavity 64*d* positioned proximal to (and underneath) the foot 42 of the rail portion 24.

As can be seen in FIG. 3, in one embodiment, the special track assembly 51 is supported on the base 27 underneath the foot 42. The base 27 preferably is a cross tie made of any suitable material, e.g., wood or a composite material, as is known. The cross ties preferably are spaced apart from each other at a predetermined spacing, as is known. Also, as shown in FIGS. 2A and 2B, in another embodiment, the supporting material 26 (preferably concrete) is positioned generally beside and engaging the parts of the covering 20 which are attached to the head 38 and the web 40, as well as underneath the foot 42.

When a streetcar or train moves over the rail portion 24, its weight (transmitted to certain of the top surfaces 58 via the wheels (FIG. 2A)) causes the special track segment 22 to move relative to the supporting material 26. For example, outward lateral movement of the special track segment 22 when the streetcar moves over it is indicated by arrow "$A_1$", and downward movement of the special track segment 22 is indicated by arrow "$A_2$", in FIG. 2B.

It will also be understood by those skilled in the art that the special track segment 22 moves again, or rebounds, after the wheels have passed. For example, the special track segment 22 rebounds generally laterally in the direction indicated by arrow "$A_3$", and the special track segment 22 also rebounds in a substantially vertical direction, e.g., as indicated by arrow "$A_4$" in FIG. 2B. Those skilled in the art will appreciate that the extent to which the special track segment 22 rebounds is not likely to be the same as the extent of the initial deflection of the special track segment 22, vertically and/or laterally.

Preferably, upon lateral movement of the rail portion 24 in the direction indicated by arrow $A_1$, the chamber wall 36 deflects inwardly (as schematically illustrated by arrows "$B_1$", "$B_2$" and "$B_3$"). Due to such deflection, energy transmitted by movement of the special track segment 22 relative to at least one of the supporting material 26 is dissipated. Accordingly, the lateral movement of the special track segment 22 is substantially not transmitted outwardly, so that the supporting material 26 is substantially undisturbed.

Similarly, because of deflection of the chamber wall 36*d* upwardly in response to the downward movement of the special track segment 22, as schematically illustrated by arrow "C", energy is dissipated, and downward movement of the special track segment 22 is substantially not transmitted to the supporting material 26.

It will be understood that the special track segment 22 may be moved in a variety of directions, i.e., movement is not necessarily lateral or vertical, but may be a combination thereof (and/or rotary movements) in response to its loading and unloading by the train, via the wheels thereof. The movements of the special track segment 22 relative to the supporting material 26 as schematically represented in FIG. 2B are exemplary only.

As shown in FIG. 3, in one embodiment, the special track assembly 51 which preferably is positioned on the base 27 is also attached to the cross tie by clamps 52, which are attached to the cross tie by fasteners 54. The clamp 52 is designed to press onto a portion 56 of the covering 20 on the foot 42 with a preselected pressure, i.e., the pressure exerted on the portion 56 preferably is within a predetermined range, so that such pressure is neither so great as to damage the covering, nor insufficient to hold the special track segment 22 in position on the base 27. In order to accomplish this, the portion 56 of the cover 20 positioned between the foot 42 and the clamp 52 preferably has a preselected thickness so that, once installed, the pressure exerted by the clamp 52 is within the predetermined range.

In use, the covering or jacket 20 is positioned on the segment 22, as shown. Because the covering 20 is positioned on the special track segment 22 prior to installation, installation of the special track assembly 51 at the site can be done relatively quickly. It is important that installation be completed in a relatively short time period, due to the need to minimize the amount of time which the site (i.e., an intersection) is closed to traffic.

Because of the cavities 64 in the covering 20, movement of the special track segment 22 when trains move over the segment 22 relative to the supporting material 26 is generally accommodated by deflection of the wall portion 36. In effect, vibration of the special track segment 22 is substantially absorbed by the covering 20. Sound is dampened due to the covering 20 isolating the special track segment 22 from the supporting material 26, to substantially reduce the extent to which movement or vibration of the special track segment 22 is transmitted to the supporting material 26. Also, because of the isolation of the special track segment 22 from the supporting material 26 by the covering, the extent to which the supporting material 26 is subjected to stress due to movement of the special track segment 22 relative thereto is minimized. Such substantial isolation is achieved by dissipation of energy due to deflection of the wall portion 36.

As will be described, the covering 20 preferably is made of a resilient material which is also an electrically insulating material. Accordingly, because the jacket 20 substantially isolates the special track segment 22 from the supporting material 26, the special track segment 22 is substantially electrically isolated from the supporting material 26 by the covering 20.

As can be seen in FIGS. 1, 2A, 2B, and 3, the special track segment 22 preferably is a casting which includes one or more pockets 48 therein, for weight reduction. Preferably, the pockets 48 are filled with a relatively lightweight filler material 50, e.g., polyurethane foam, to at least partially define a bottom surface 68 (FIG. 3). Filling the pockets 48 with the lightweight filler material 50 is advantageous compared to the prior art practice of filling such pockets with concrete, because of the relatively higher cost of the concrete and the substantially greater density of concrete. The special track segment 22 in which the pockets 48 have been substantially filled with polyurethane foam is much easier to handle (due to weight differences) than, for example, one in which the pockets 48 have been filled with concrete.

The special track segment 22 is at least partially defined by a number of exterior side surfaces 66 and the top surfaces 58 (FIGS. 2A-3). As can be seen in FIGS. 2A-3, the filler material 50 is inserted in a pocket 48 to substantially fill the pocket 48 and at least partially define an exterior bottom surface 68.

Figure 6:
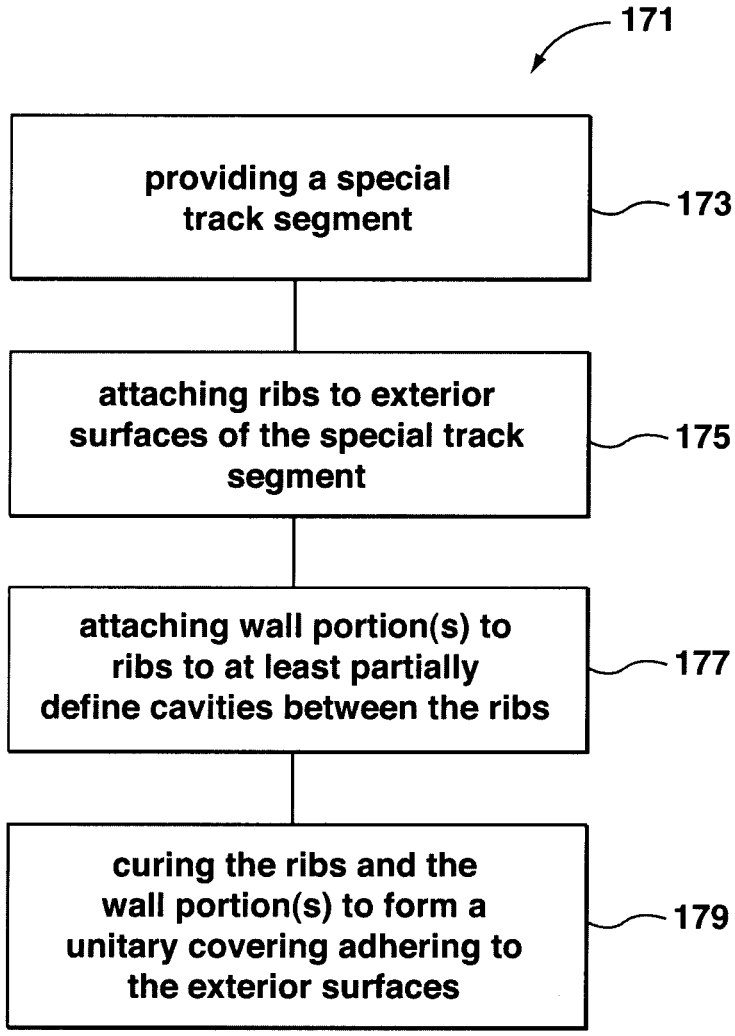
FIG. 6 is a flow chart schematically illustrating an embodiment of a method of the invention.
Figure 7:
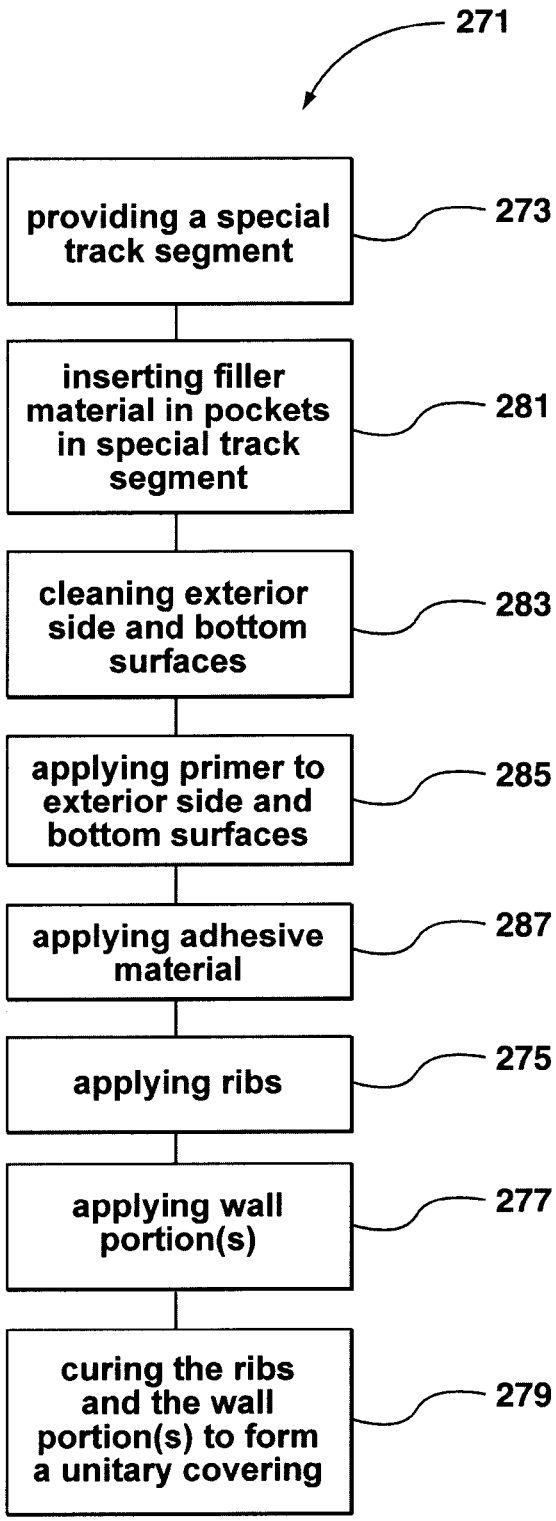
FIG. 7 is a flow chart schematically illustrating another embodiment of a method of the invention.

In one embodiment, a method 171 of making the special track assembly 51 of the invention includes an initial step of providing a special track segment 173 (FIG. 6). Next, the ribs 60 are attached to exterior surfaces 30 of the special track segment 22 (step 175). Wall portions 36 are then attached to the ribs 60 to at least partially define the cavities 64 between the ribs 60 (step 177). Preferably, the ribs 60 and the wall portions 36 are then cured to form a unitary covering 20 adhering to the exterior surfaces 30, for engagement with the supporting material 26 (step 179).

In another embodiment of a method 271 of making the special track assembly 51 of the invention (schematically illustrated in FIG. 7), the first step 273 is providing the special track segment 22. Next, the filler material is inserted into the pockets 48 to substantially fill the pockets and at least partially define the exterior bottom surface (step 281). Subsequently, the side and bottom exterior surfaces 66, 68 are cleaned in any suitable manner so that a primer is adherable thereto (step 283). The primer is then applied to the exterior side and bottom surfaces to provide primed exterior surfaces thereon (step 285). Next, a layer of adhesive material is applied to the primed exterior surfaces, to provide adhesive-covered exterior surfaces thereon (step 287). The ribs 60 preferably are then applied to the adhesive-covered exterior surfaces (step 275). Adjacent ones of the ribs 60 are spaced apart from each other by predetermined distances to provide gaps 62 therebetween respectively. Next, one or more wall portions 36 are attached to the ribs 60 (step 277). The wall portions 36 are for bridging gaps 62 to at least partially define the cavities 64 between the adjacent ribs 60 respectively, as described above. Finally, the ribs 60 and the wall portions 36 are cured, to form the ribs 60 and the wall portions 36 into the unitary covering 20 adhering to the exterior side and bottom surfaces (step 279).

Those skilled in the art would generally be aware of the manner in which the segment is cleaned, e.g., by sandblasting or shotblasting, and it is therefore unnecessary to provide further details regarding this step.

Any suitable primer may be used. The types of primer which would be suitable are known to those skilled in the art. For example, it has been found that Chemlok 205, an adhesive promoter available from Lord Corporation of Cary, N.C., U.S., is a suitable primer.

Any suitable adhesive may be used. Various types of cement may be suitable. For example, it has been found that one coat of Chemlok 252X rubber to steel cement, followed by two coats of compound-specific cement, provides a suitable layer of cement.

The ribs 60 preferably are suitably sized and positioned to provide the spaces therebetween which will result in appropriately located and sized cavities. The ribs 60 preferably are positioned in a predetermined pattern on the segment so that, after the rubber blanket portion is positioned on the ribs, the chambers are substantially defined by the ribs. The sizing and positioning of the ribs determine the sizing and locations of the cavities. In one embodiment, for example, the ribs are approximately ⅛" thick and approximately ¾" wide, and positioned apart at approximately ¾" spacings.

Also, the wall portions 36 preferably are suitably sized and positioned to dissipate energy, as described above. For example, for ribs sized as described above, it has been found that the wall portion 36 should be between about ¼" and about ½" in thickness.

It is preferred that the filler material 50 is any suitable material. For example, the filler material 50 preferably is polyurethane, delivered into the pocket 48 as a foam, to fill the pocket 48 relatively completely. However, during curing (i.e., in an autoclave), gases are released by the polyurethane. It will be appreciated by those skilled in the art that such released gases may be vented in various ways. For example, in one embodiment, a tube is embedded in the polyurethane in each pocket respectively, which extends past the wall portion(s) covering the bottom exterior surfaces, to release the gases. After curing, the tube preferably is cut off, and plugged with a sealant.

In addition, excess resilient material preferably is trimmed after curing.

Figure 8A:
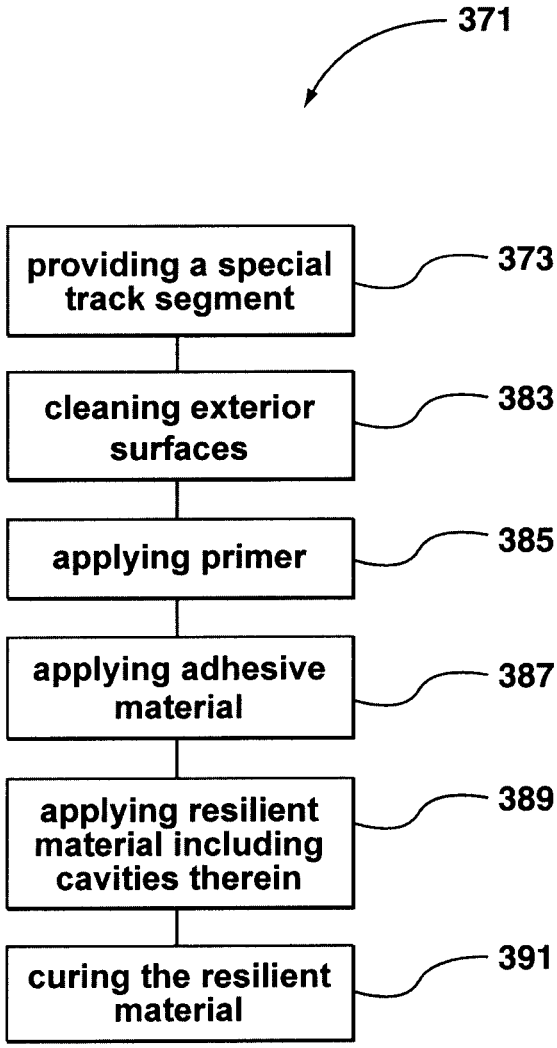
FIG. 8A is a flow chart schematically illustrating another embodiment of a method of the invention.
Figure 8B:
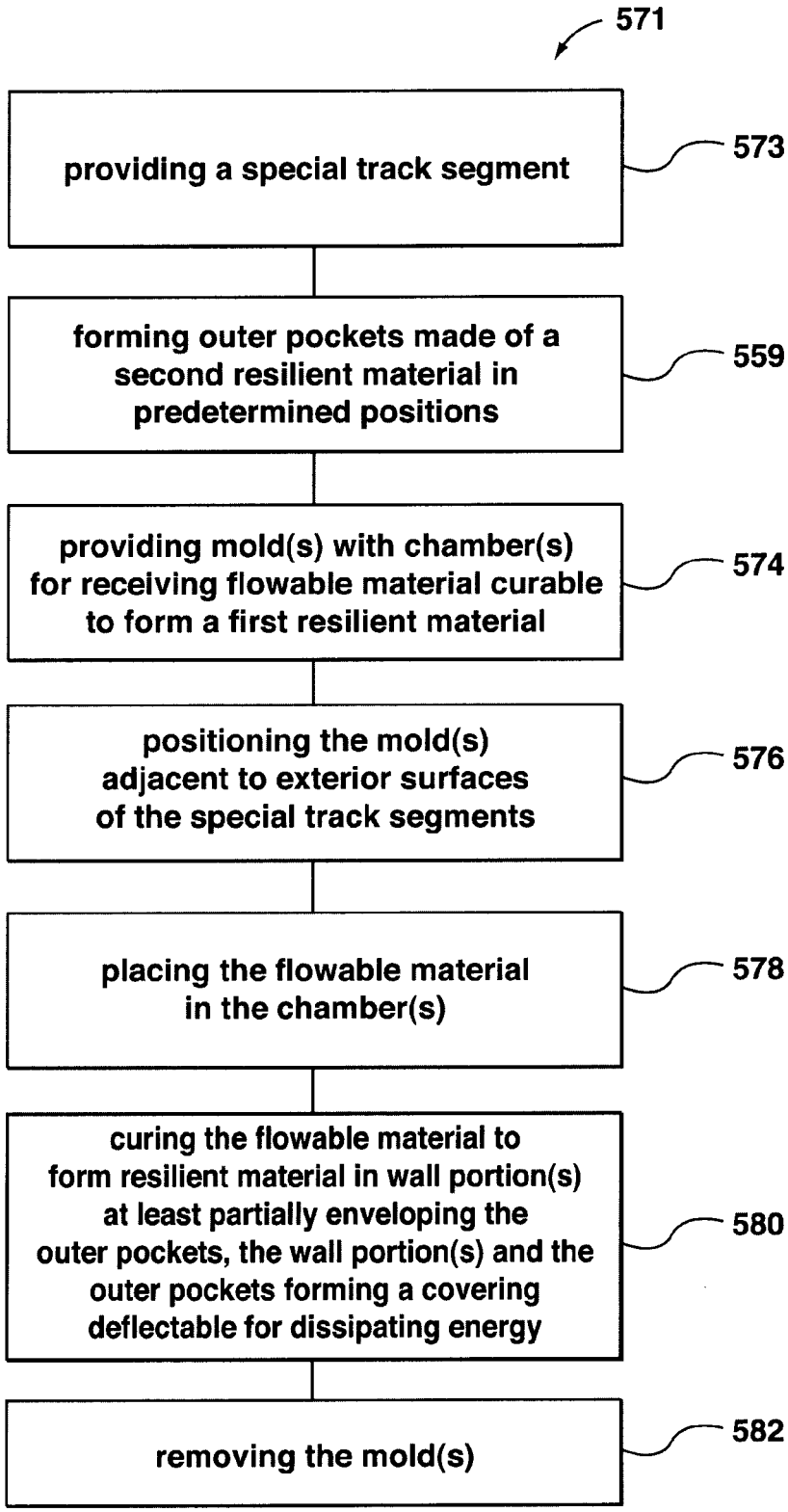
FIG. 8B is a flow chart schematically illustrating another embodiment of a method of the invention.

Another embodiment of a method 371 of the invention is schematically illustrated in FIG. 8A. The method is for forming the resilient covering or jacket for the special track segment. First, the special track segment is provided (step 373). Next, exterior surfaces of the special track segment are cleaned (step 383). Subsequently, primer is applied (step 385). Subsequently, adhesive material is applied (step 387). Resilient material including cavities therein is applied to the adhesive-covered exterior surfaces (step 389). Finally, the resilient material is cured, to form the resilient material into a unitary covering adhering to the exterior surfaces for engagement with the supporting material (step 391). Preferably, the resilient material is also electrically insulating material, for electrically isolating the special track segment relative to the supporting material.

Figure 4:
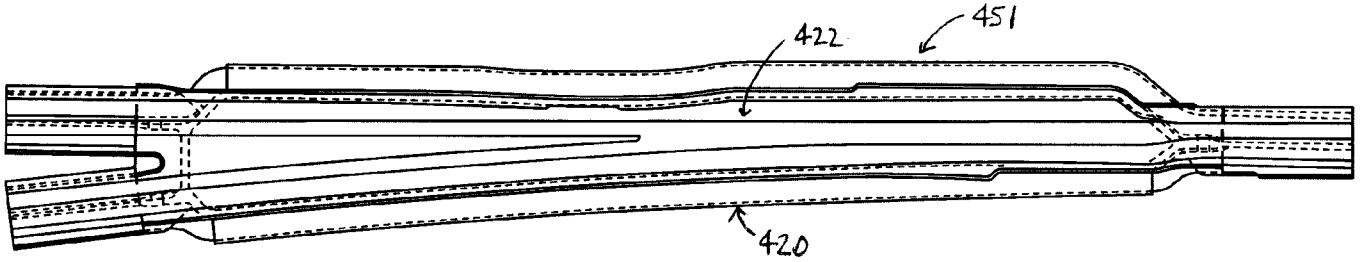
FIG. 4 is a top view of another embodiment of the special track assembly of the invention, drawn at a smaller scale.
Figure 5:
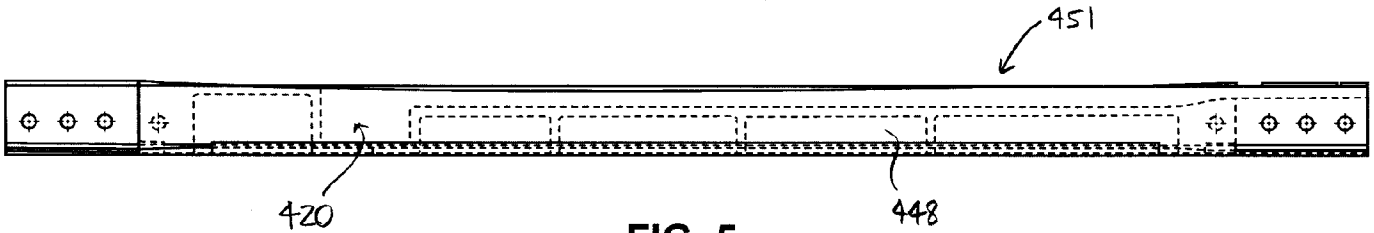
FIG. 5 is a side view of the special track assembly of FIG. 4.

It will be understood that the special track segment 22 shown in FIG. 1 is exemplary only. Those skilled in the art would appreciate that special track is provided in many different forms. The special track segment may be tailored for use in a specific portion of a track system in a specific intersection. For example, another special track segment 422 is shown in FIGS. 4 and 5, with a covering 420 thereon, to form a special track assembly 451.

In one embodiment, preselected surface areas 46 of the segment 22 preferably are not covered by the covering 20 (FIG. 1). This is done so that electrically conductive connections may be made between the exposed surface 46 of the segment 22 and another part (or parts) of the rail system (not shown in FIGS. 1-5) when the special track assembly is installed. It will be appreciated by those skilled in the art that suitable electrical connections may be made in various ways. For example, a bond cable 72 (FIG. 2A) may be attached to the surface area 46 which was left bare for the purpose. As is well known in the art, the bond cable 72 may, for example, be welded to the special track assembly 22 in the area 46. The bond cable 72 and the area 46 are subsequently covered with an electrically insulating material, for electrical isolation relative to the supporting material. Preferably, the electrically insulating material is also resilient, e.g., rubber, and is glued or otherwise suitably attached to the cover 20 (FIG. 2A).

Other embodiments of the invention are described herein. In connection with such other embodiments, elements are numbered so as to correspond to the elements of the covering 20 and other elements related thereto.

Figure 8C:
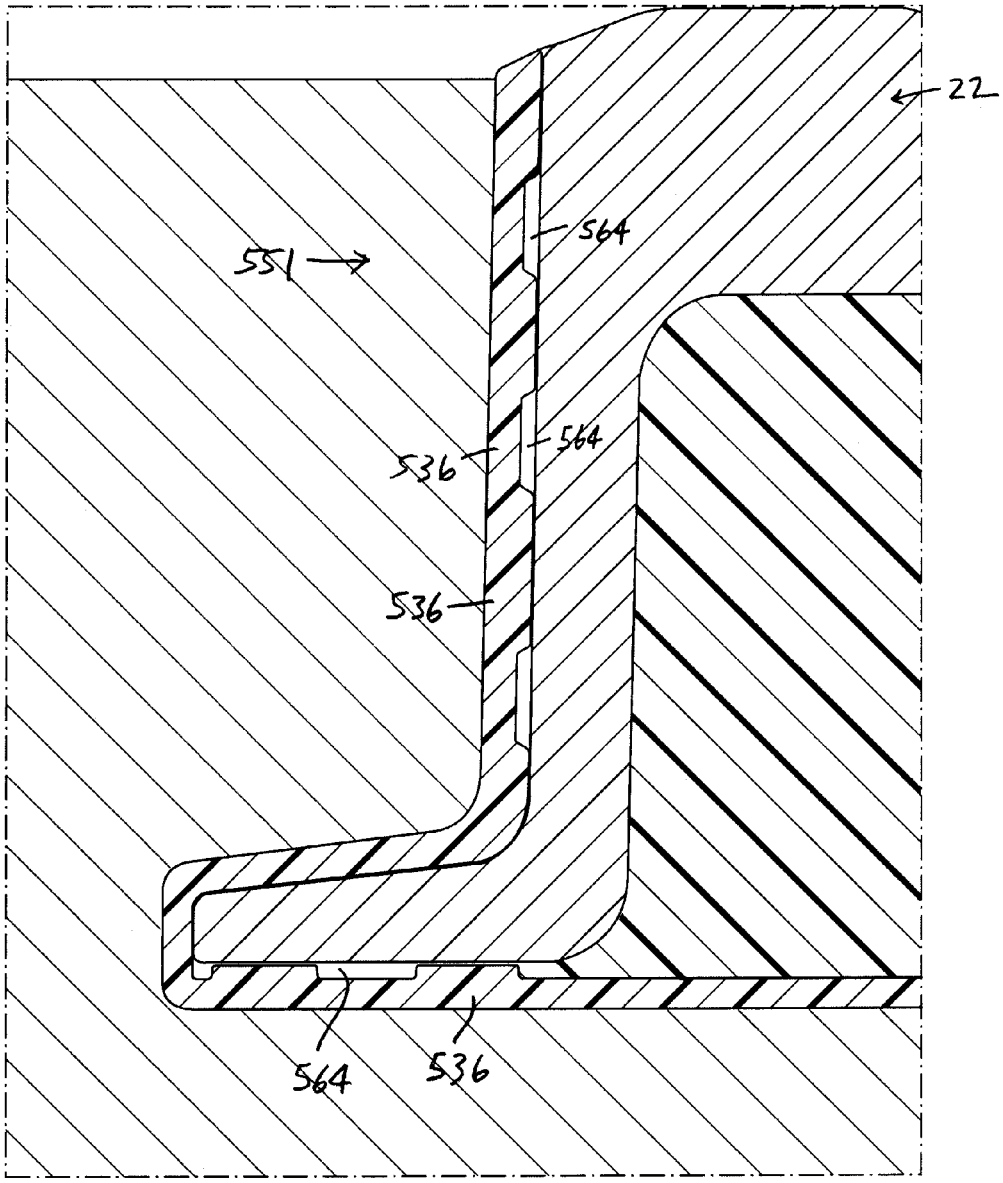
FIG. 8C is a cross-section of a portion of another embodiment of the special track assembly of the invention, drawn at a larger scale.

A portion of another embodiment of the special track assembly 551 is shown in FIG. 8C. As can be seen in FIG. 8C, a wall portion 536 thereof made of a first resilient material at least partially defines a number of outer pockets 564 which preferably are filled with a second resilient material that preferably is a closed-cell foam material 557.

Preferably, the wall portion 536 of the covering 520 is made of any suitable material, i.e., a material having suitable resilience and deflection characteristics. One such material is polyurethane. Those skilled in the art would be aware of other suitable materials.

A suitable closed-cell foam material 557 preferably is inserted into the outer pockets 564. The material 557 may be any suitable closed-cell foam material. Preferably, the material preferably is polyurethane foam. The material of the wall portion 536 (the first resilient material) and the material positioned in the outer pockets 564 (the second resilient material) respectively are selected so that the covering 520 has appropriate resilience and deflection characteristics overall.

The special track segment 522 is at least partially defined by a number of exterior surfaces 30 and top surfaces 58 thereof. As can be seen in FIG. 8C, a covering 520 includes the layer or wall portion 536 of the first resilient material which preferably is attached to the exterior surfaces 30 as will be described. The covering includes a number of outer pockets 564 in which the second resilient material is positioned, the outer pockets being configured so that the layer 536 is deflectable for dissipating energy transmitted by movement of the special track segment 522 relative to the supporting material.

Figure 8D:
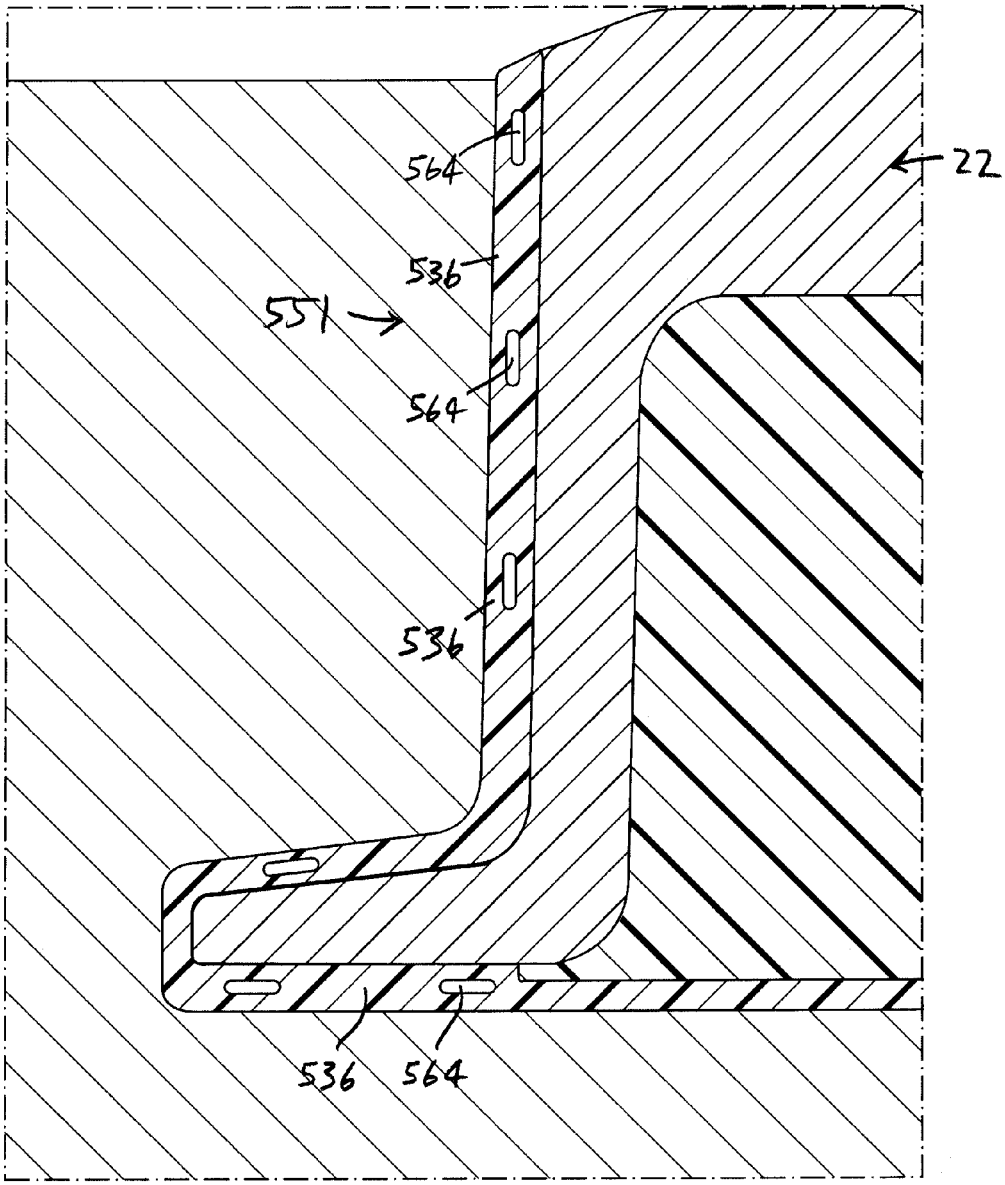
FIG. 8D is a cross-section of a portion of another embodiment of the special track assembly of the invention.

It will be appreciated by those skilled in the art that the outer pockets 564 are not necessarily positioned adjacent to the special track segment 522. In FIG. 8D, another embodiment of the special track assembly 551 is disclosed. In this embodiment, the outer pockets 564 are not positioned adjacent to the special track segment 22. The outer pockets 564 preferably are positioned as is advantageous in the wall portion 536. It will be understood that the positions and sizing of the outer pockets 564 as shown in FIGS. 8C and 8D are exemplary only.

In another embodiment of a method 571 of making the special track assembly 522 (schematically illustrated in FIG. 8B), the first step 573 is providing the special track segment. Next, the outer pockets 564 of the second resilient material are formed (step 559). The outer pockets are located in predetermined positions respectively relative to the exterior surfaces. (As noted above, the outer pockets 564 may be positioned on the exterior surfaces 530, or the outer pockets may be positioned in the layer 536 spaced apart from the exterior surfaces 530 by predetermined amounts.) Next, molds are provided with chambers for receiving pourable material curable to form a resilient material (step 574). The molds are positioned adjacent to exterior surfaces of the special track segment (step 576). The pourable material is placed in the chambers (step 578). Next, the pourable material is cured to form resilient material in the wall portions (or layer) at least partially enveloping the outer pockets so that a covering 520 is formed which is deflectable for dissipating energy (step 580). Finally, the molds are removed (step 582).

Any suitable pourable material may be used. Preferably, the pourable material is polyurethane in liquid form which, when cured, has the appropriate resilient characteristics. Those skilled in the art would be aware how to form molds to contain the pourable material, and it is therefore not necessary to provide further details in this regard.

Figure 11:
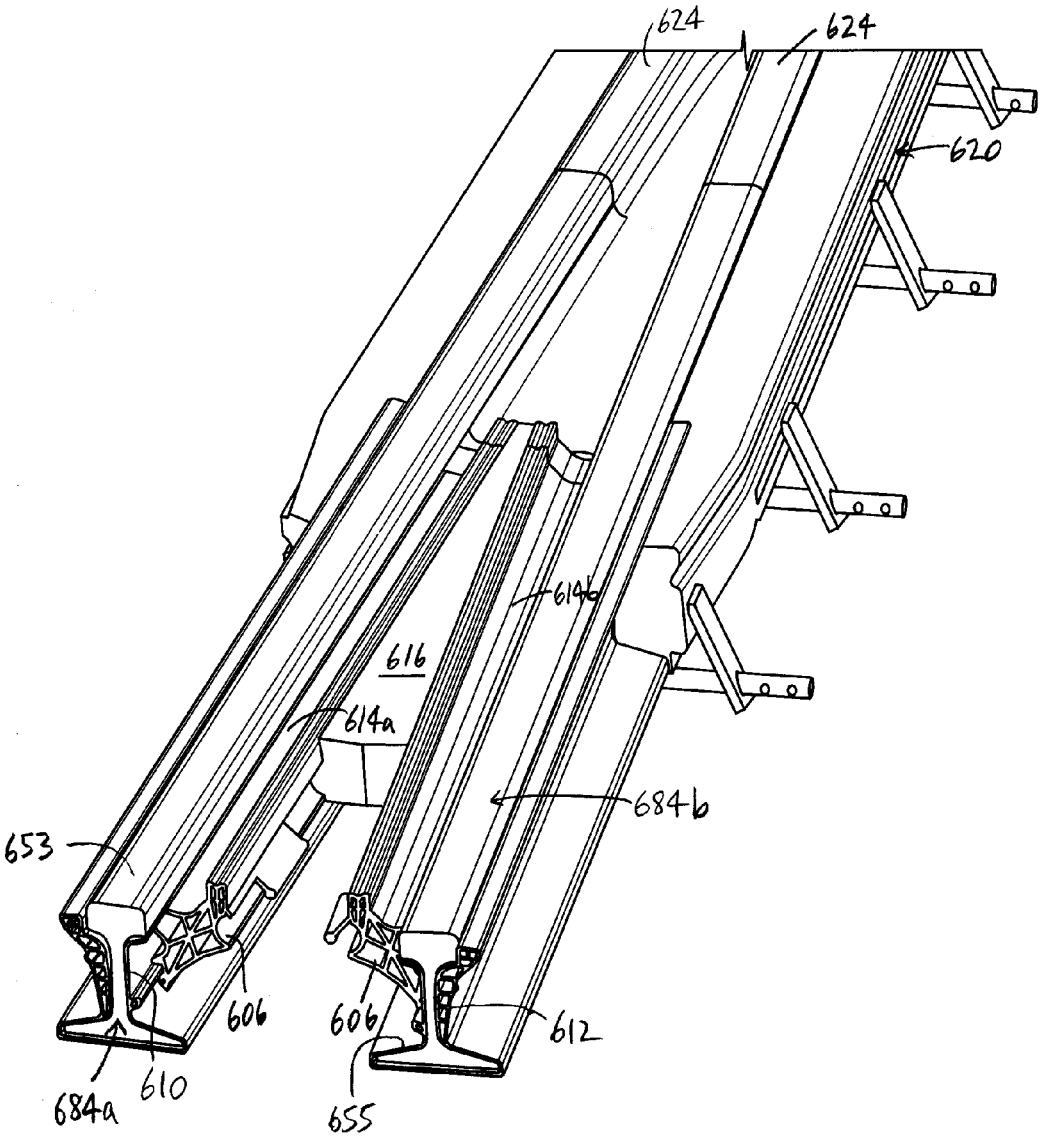
FIG. 11 is an isometric view of another embodiment of the special track assembly of the invention, drawn at a smaller scale.
Figure 12:
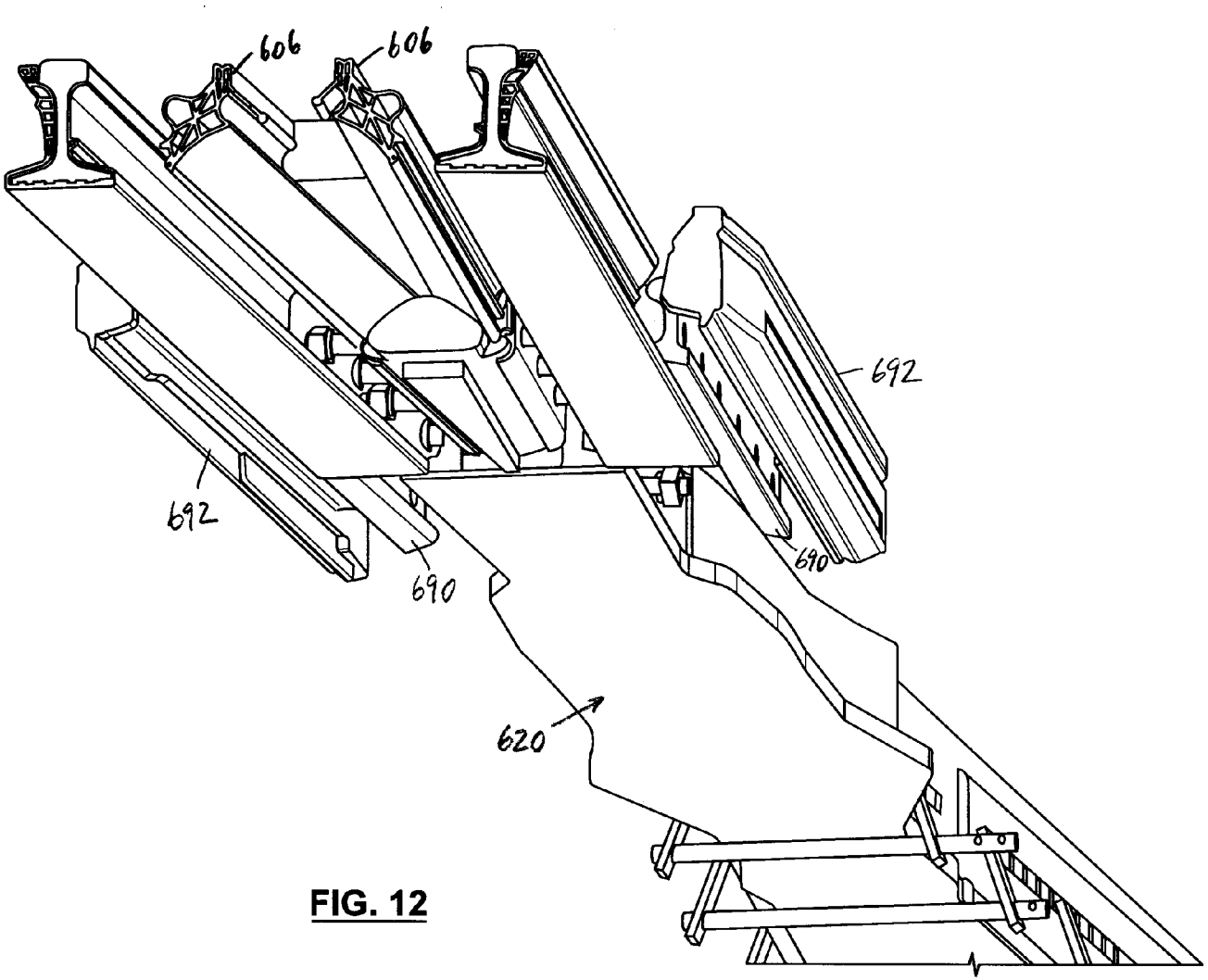
FIG. 12 is a partially exploded isometric view of the special track assembly of FIG. 11, drawn at a larger scale.
Figure 13:
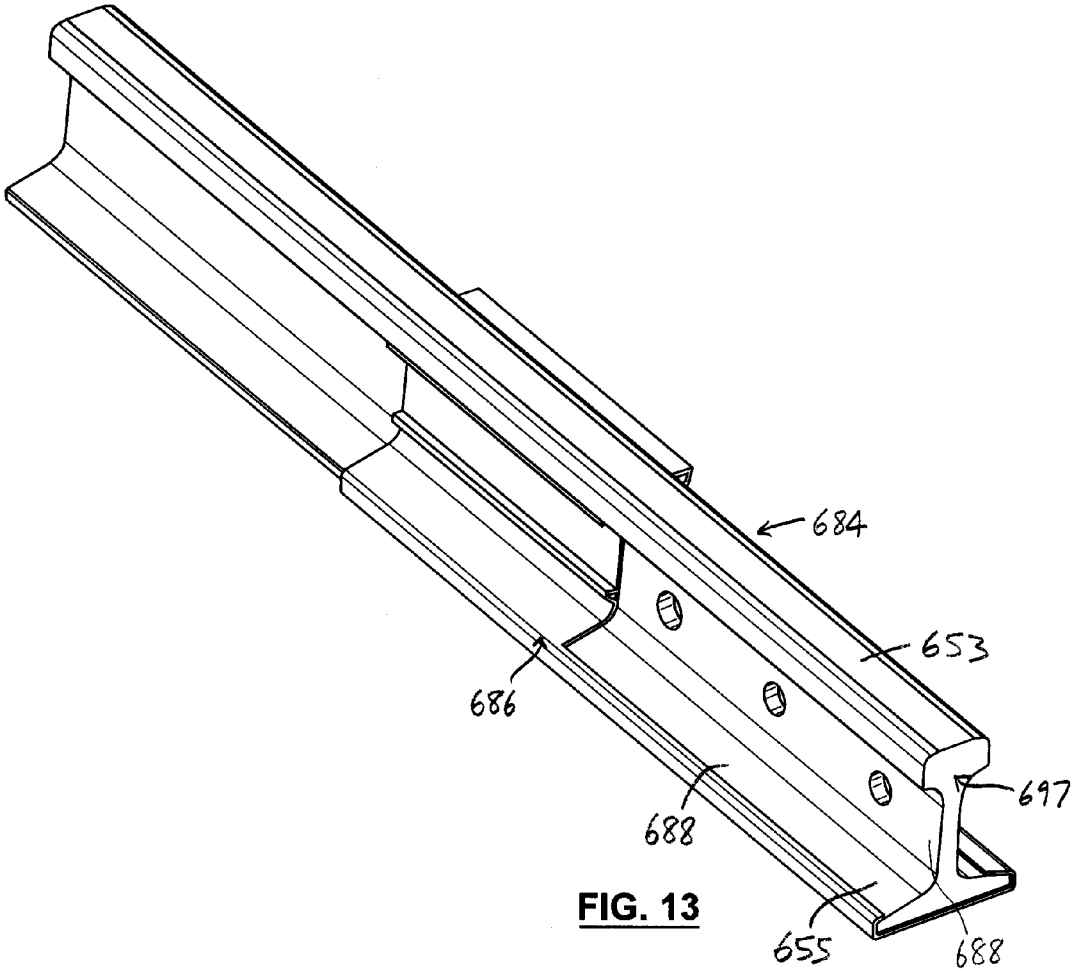
FIG. 13 is an isometric view of a straight track portion with a boot thereon.

A special track assembly 651 (or elements thereof) is disclosed in FIGS. 9-21. When installed, the special track assembly 651 is at least partially supportable by the supporting material (not shown in FIGS. 9-21), and is adapted for connection with one or more straight track portions 684. The straight track portion 684 includes a boot 686 made of electrically insulating material and partially covering a straight rail segment 697 of the straight track portion 684 to define one or more exposed surfaces 688 thereof (FIG. 13). In one embodiment, the special track assembly 651 includes the special track segment 622 with one or more rail portions 624 and a body portion 625 connected to the rail portions 624. The special track segment 622 is at least partially defined by a number of exterior surfaces 630 and the top surfaces 658 thereof. As can be seen in FIG. 11, the rail portions 624 preferably are substantially alignable with the straight track portions 684 upon respective ends of the rail portions 624 and the straight track portions 684 being positioned to abut each other. Preferably, the special track assembly 651 includes a layer or covering 620 of electrically insulating material attached to the exterior surfaces 630 for substantially electrically isolating the special track segment 622 relative to the supporting material to set the supporting material (not shown in FIGS. 9-21). In one embodiment, the special track assembly 651 also includes a connecting element 690 for electrically connecting the special track segment 622 and the straight rail segments 697. Also, the special track assembly 651 preferably also includes a connecting portion 692 of electrically insulating material for substantially electrically isolating at least the connecting element 690 and the exposed surface 688 relative to the supporting material (FIG. 12).

The straight rail segment 697 preferably is at least partially defined by a number of top surfaces 653 thereof and a number of exterior surfaces 655 thereof.

Figure 9:
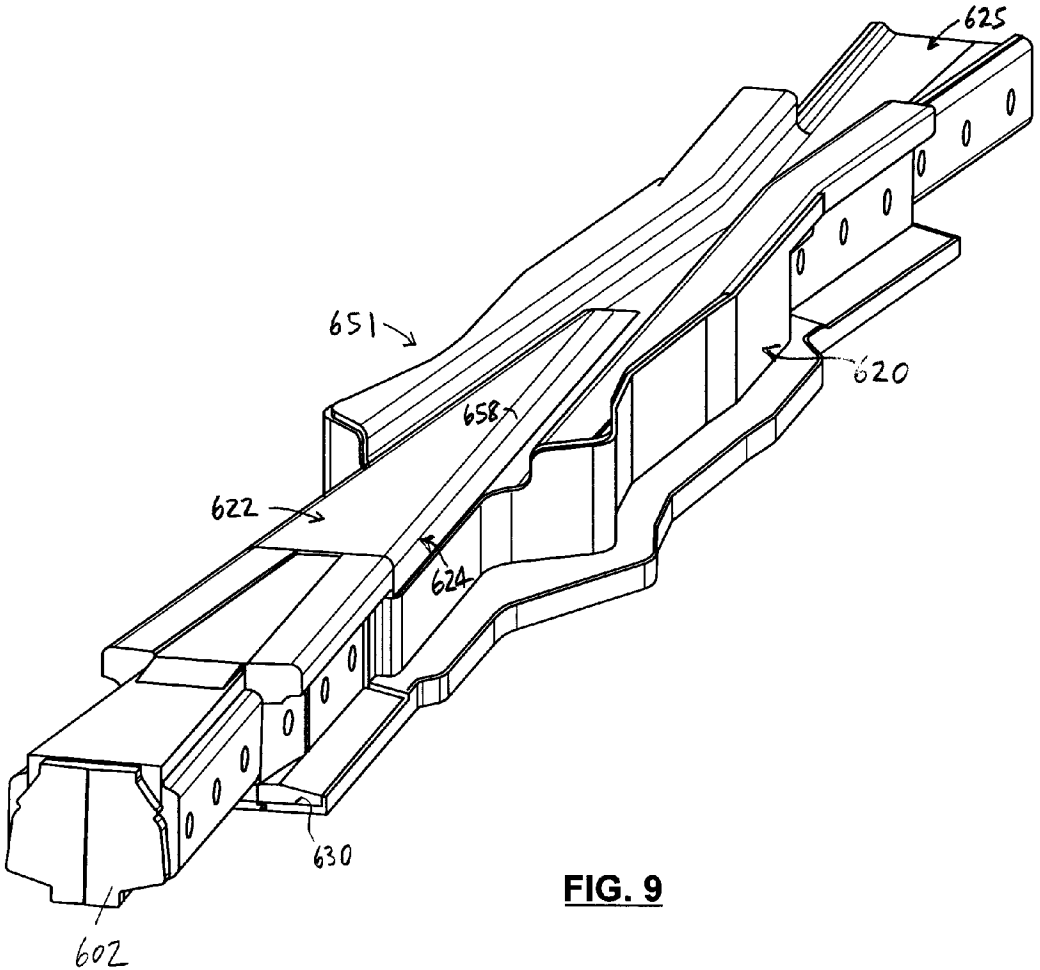
FIG. 9 is an isometric view of another embodiment of the special track assembly of the invention, drawn at a smaller scale.
Figure 10:
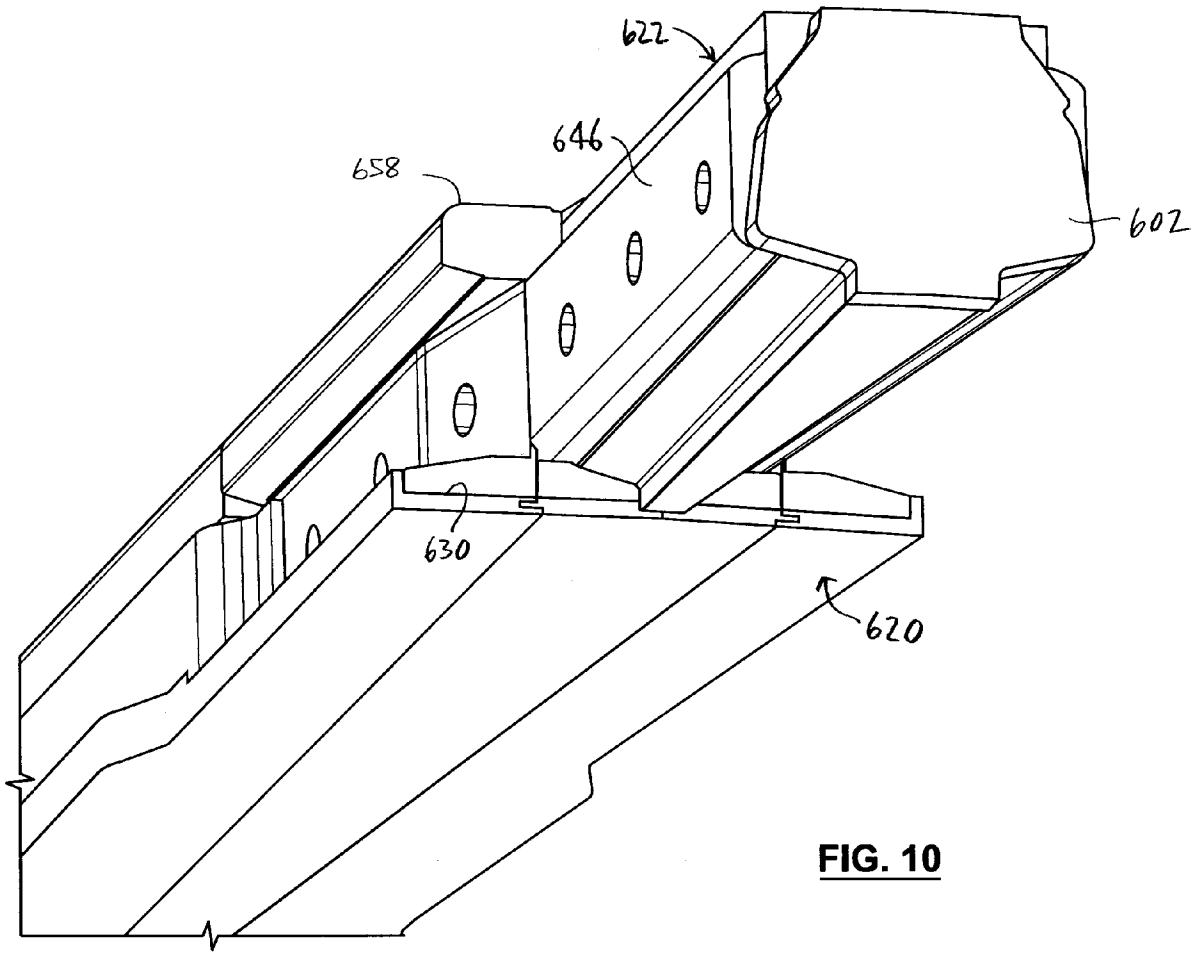
FIG. 10 is an isometric view of a portion of the special track assembly of FIG. 9, drawn at a larger scale.

As can be seen in FIGS. 9 and 10, the special track segment 622 includes one or more exposed surfaces 646 which are not directly covered by the layer 620 of electrically insulating material. The electrically conductive connection which is made between the straight track segment 622 and the straight rail segment 697 preferably is made between the exposed surface 646 and the exposed surface 688 of the straight rail segment 697. As described above, such electrically conductive connection preferably is made by the connecting element 690.

Figure 14:
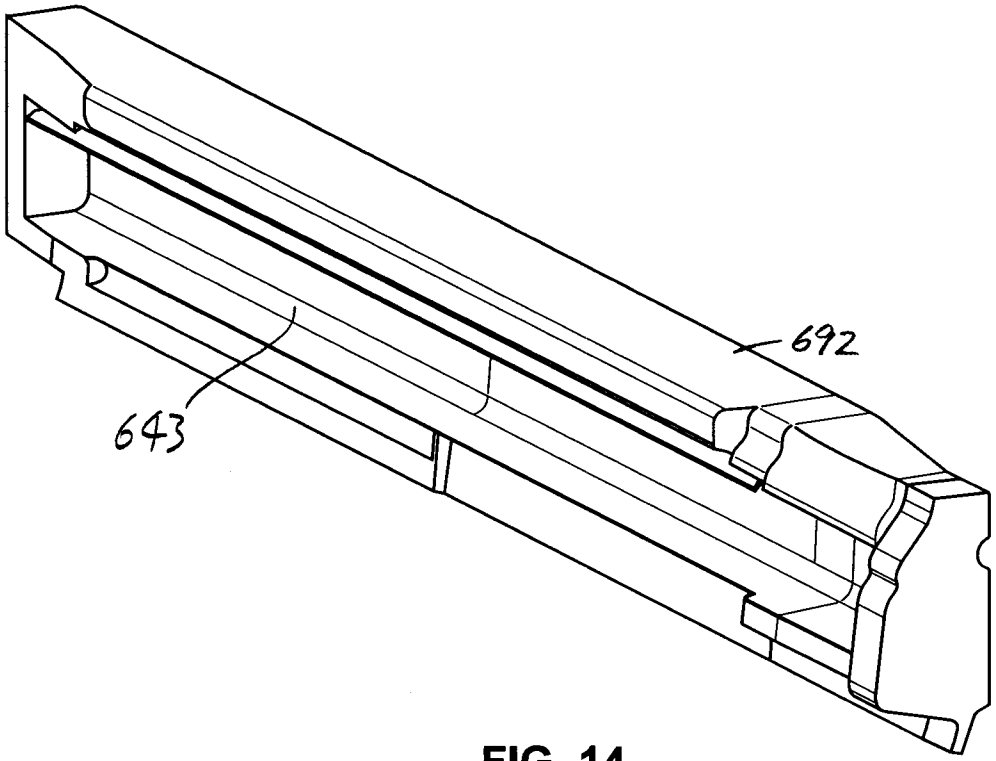
FIG. 14 is an isometric view of an embodiment of a connecting portion of the invention, drawn at a larger scale.

In one embodiment, the connecting element 690 preferably is a joint bar. The connecting portion 692 preferably is formed to fit over the connecting element 690, for electrically isolating at least the connecting element 690 and the exposed surface 688 relative to the surrounding material. An example of a connecting portion 692 which is formed to fit over the connecting element 690 is shown in FIG. 14. As can be seen in FIG. 14, the connecting portion 692 preferably includes a groove 643 in which the connecting element 690 is at least partially receivable.

Figure 17:
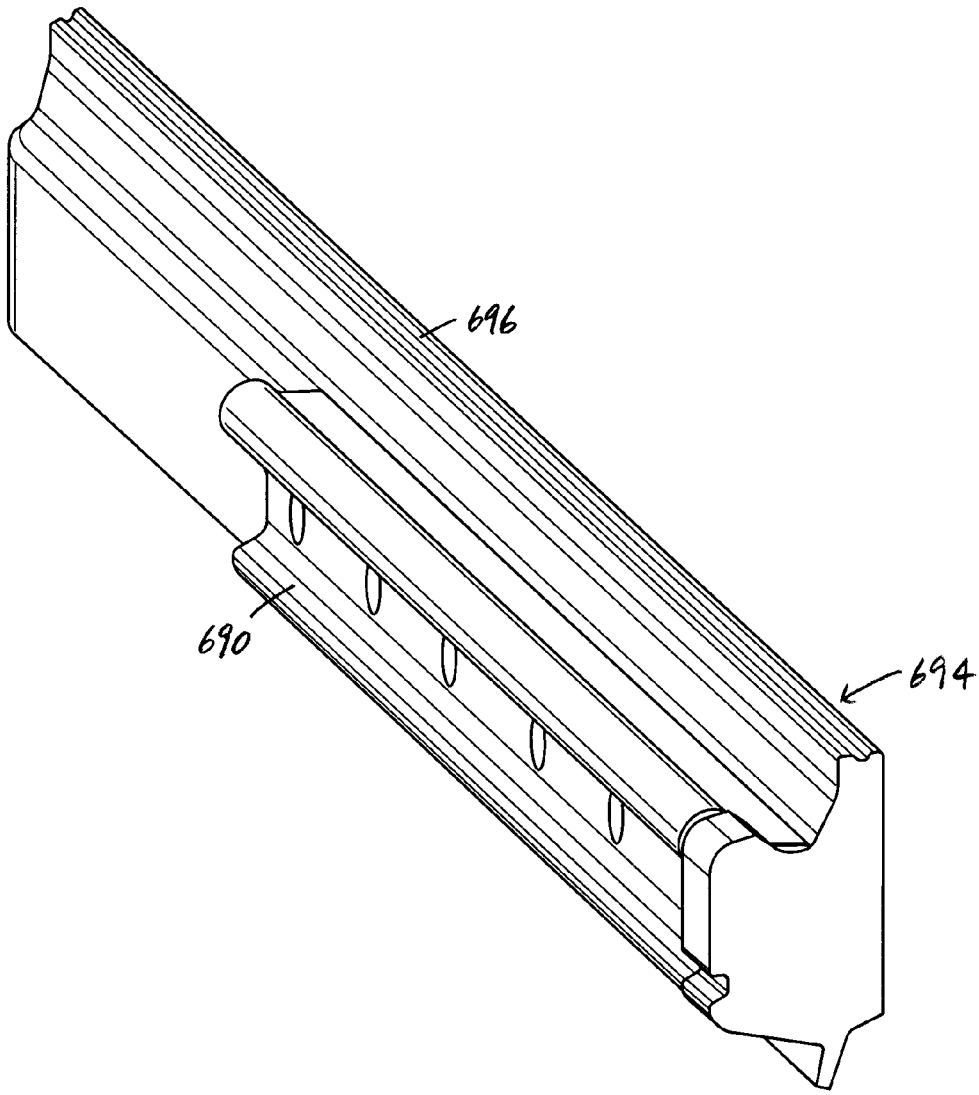
FIG. 17 is an isometric view of an embodiment of a connector of the invention, drawn at a larger scale.
Figure 18:
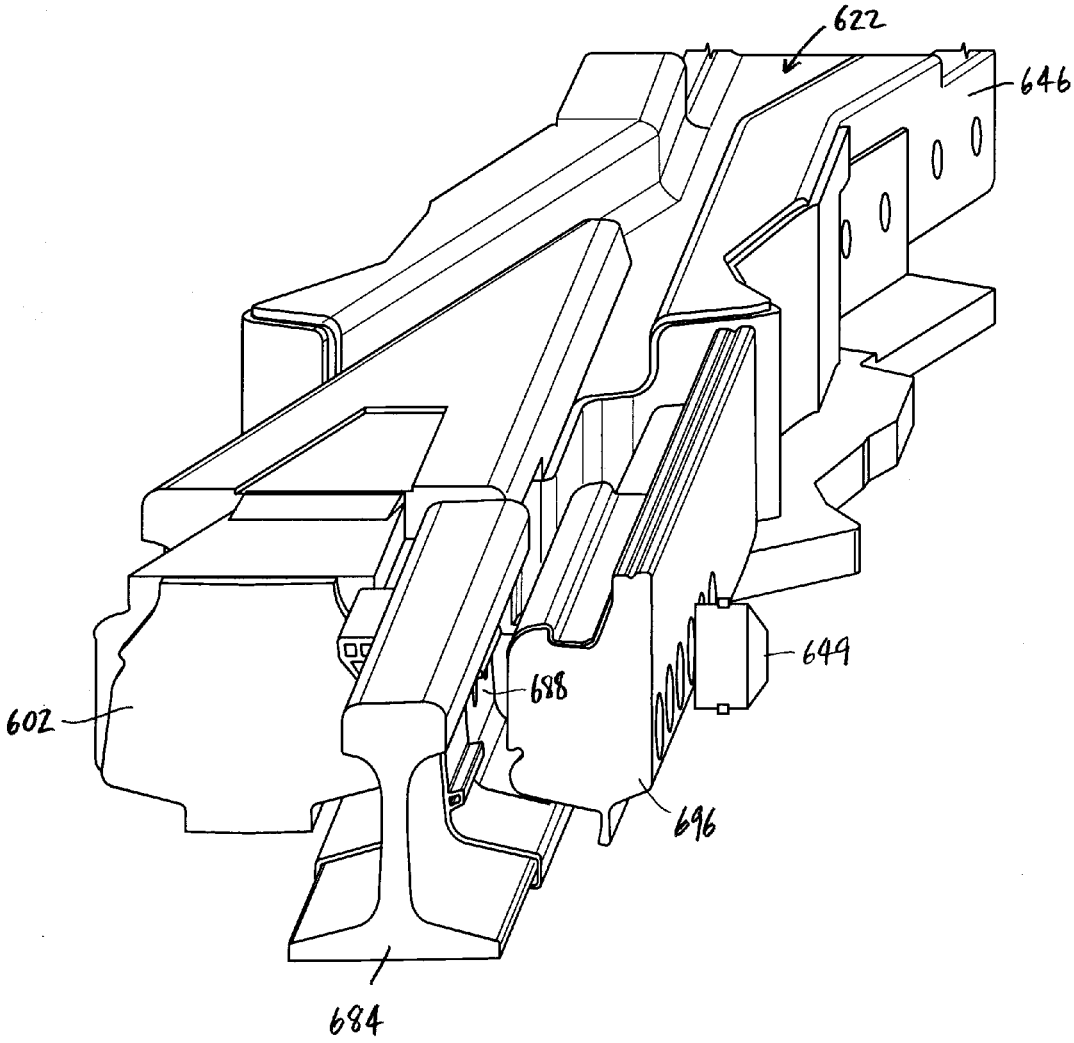
FIG. 18 is a partially exploded isometric view of another embodiment of a special track assembly of the invention, drawn at a smaller scale.
Figure 19:
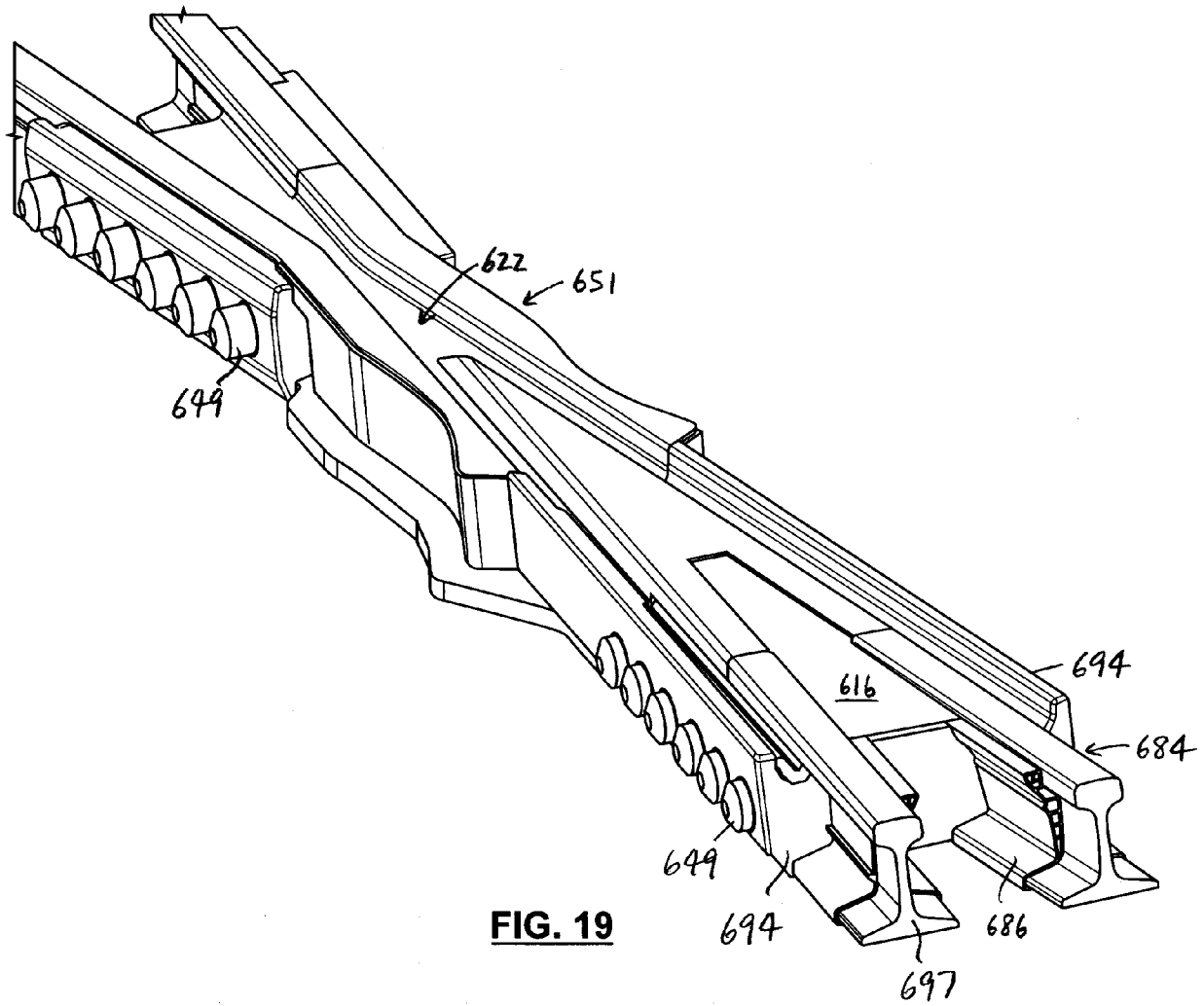
FIG. 19 is an isometric view of the special track assembly of FIG. 18, drawn at a smaller scale.

In another embodiment, the connecting portion and the connecting element are molded together to form a connector 694 (FIG. 17) for electrically isolating at least the connecting element 690 and the exposed surface 688 relative to the supporting material. As can be seen in FIG. 17, the connector consists at least of the connecting element 690 integrated into a body portion 696 of the connector 694, the body portion 696 being formed of electrically insulating material.

Preferably, the straight track portion 684 is positioned so that the exposed surface 688 engages the exposed surface 646 of the special track segment 622. The connecting element 690 is positioned to connect the straight track portion to the special track segment.

Figure 15:
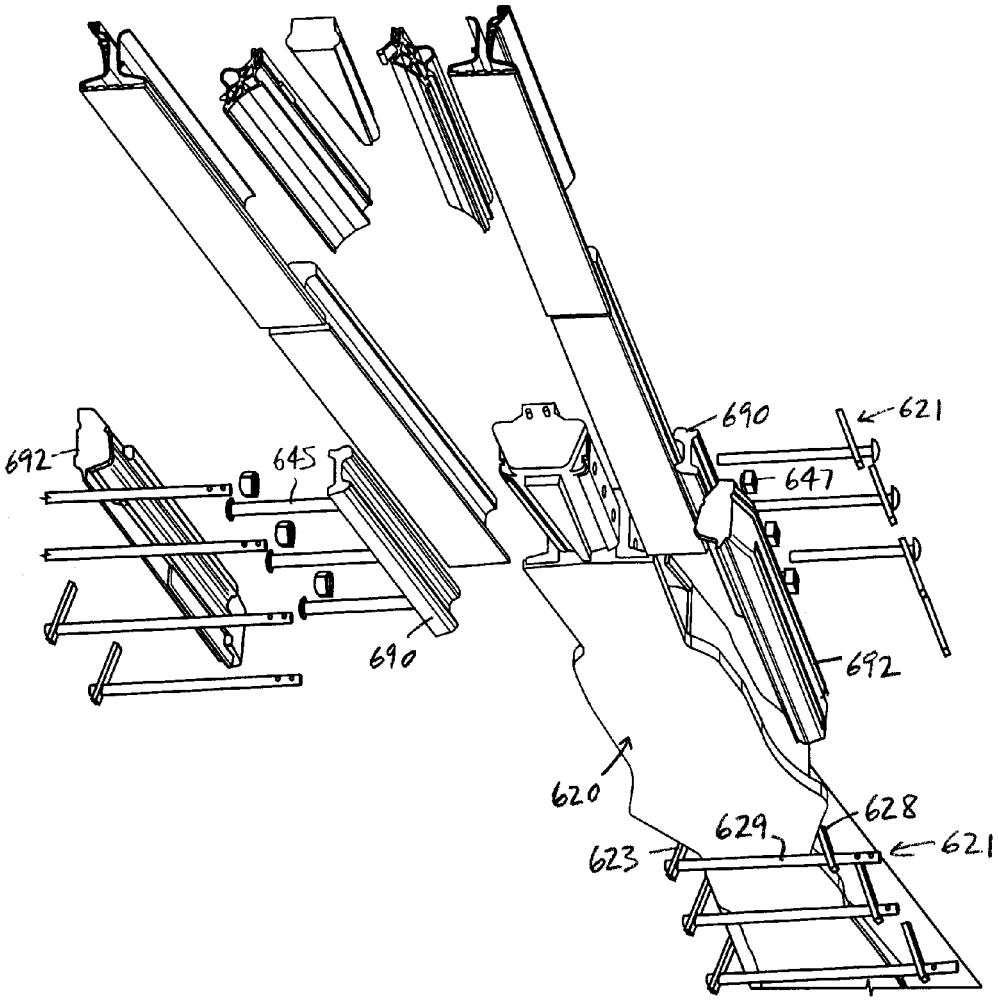
FIG. 15 is an exploded isometric view of the special track assembly of FIG. 12, drawn at a smaller scale.

As can be seen in FIG. 15, the joint bars 690 preferably are secured to the special track segment 622 and to the straight rail segment 697 by bolts 645 and nuts 647, as is known. The nuts and bolts typically are made of any suitable metal, e.g., a suitable steel. Accordingly, in order to electrically isolate the special track segment 622 and the straight rail segment 697 relative to the supporting material, the special track assembly 651 preferably includes caps 649 made of an electrically insulating material. The caps 649 are positioned on the nuts 647, and on ends of the bolts 645 which are exposed after the nuts and bolts are tightened. The caps 649 are configured and positioned so as to cover any exposed metal surfaces.

It will be appreciated by those skilled in the art that the electrically conductive connection between the special track segment and the straight rail segment may be made using devices other than the joint bar. For example, the connecting element 690 may be a bond cable.

Preferably, the special track assembly 651 additionally includes an end portion 602 (FIGS. 9, 10) made of the electrically insulating material. The end portion 602 is for at least partially electrically isolating the special track segment 622 relative to the supporting material. The end portion 602 preferably is attachable to the body portion 625 using any suitable means.

Figure 20:
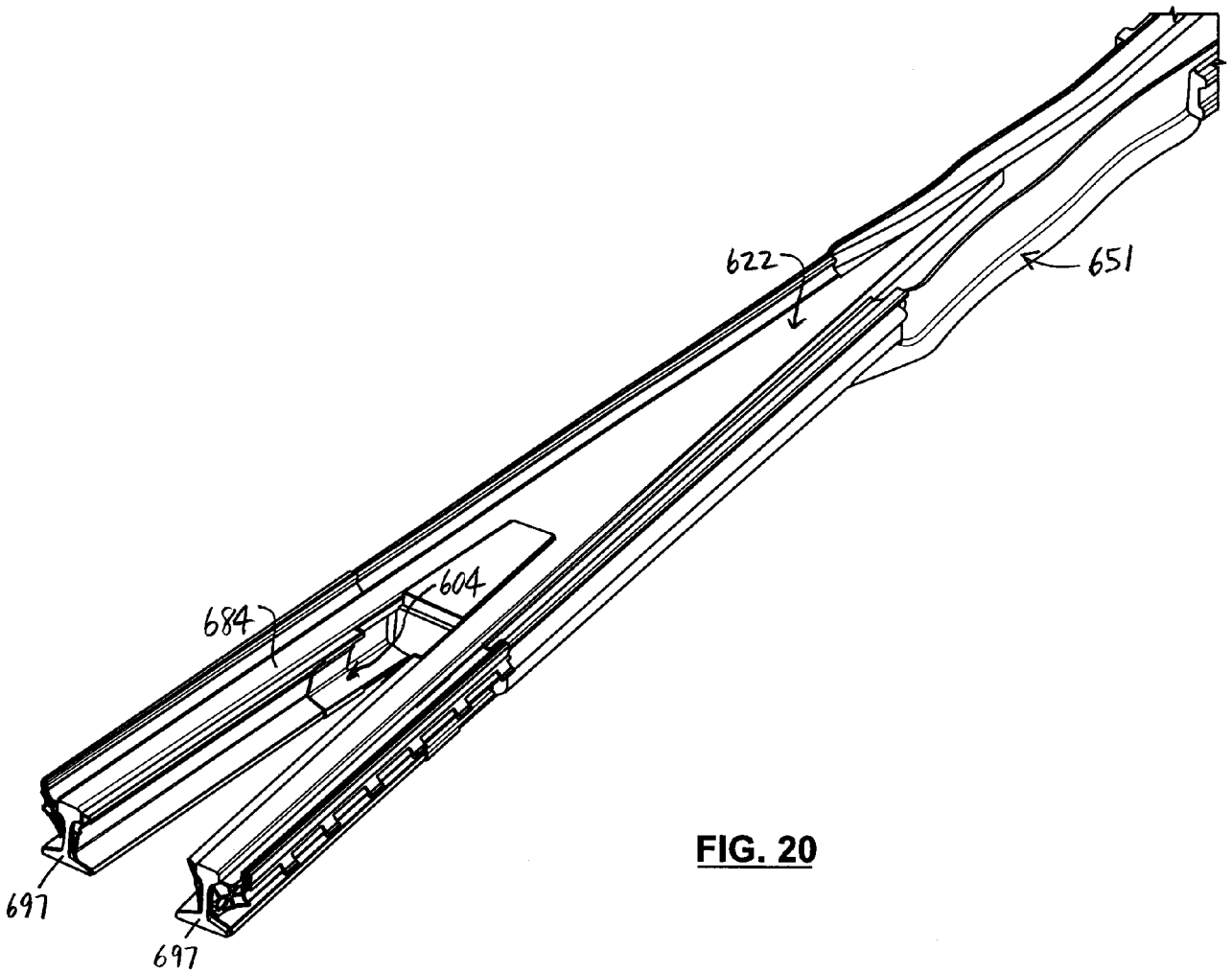
FIG. 20 is an isometric view of another embodiment of the special track assembly of the invention, drawn at a smaller scale.
Figure 21:
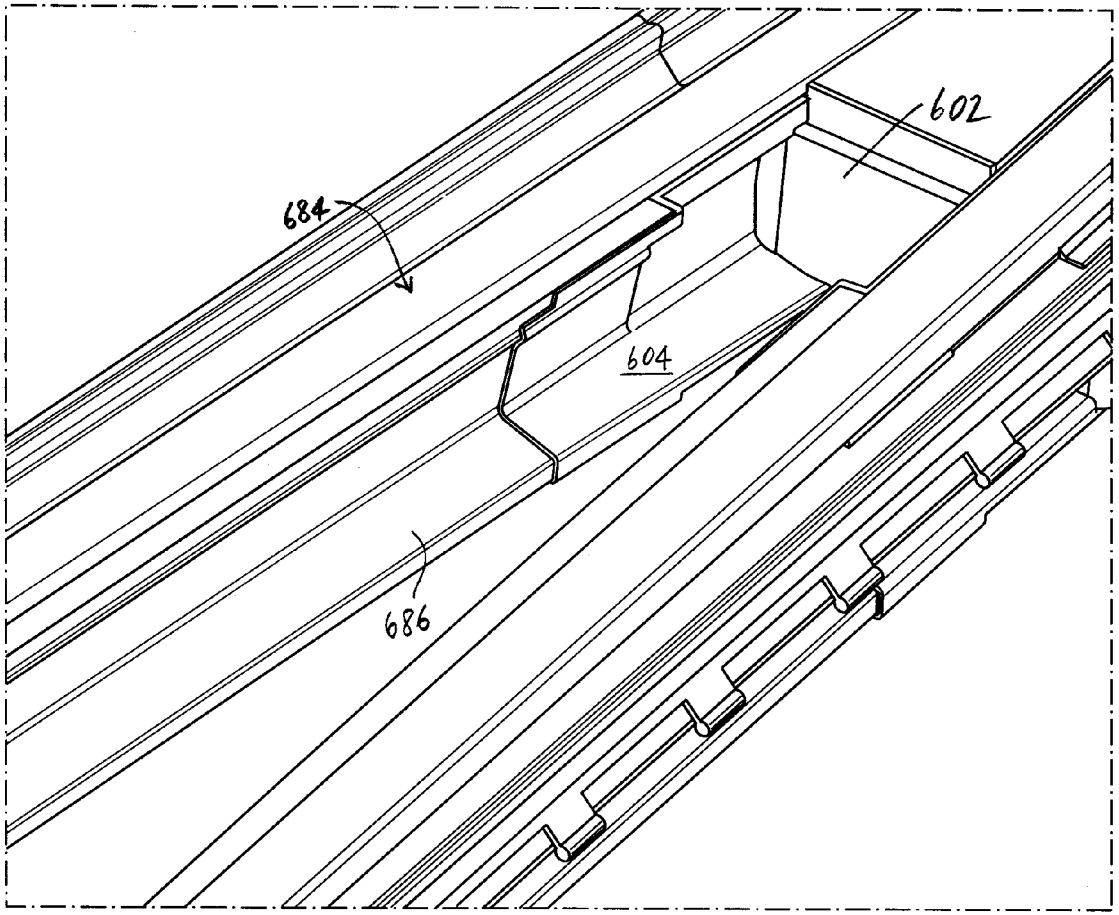
FIG. 21 is an isometric view of an embodiment of an overlapping element of the invention, drawn at a larger scale.

As can be seen in FIGS. 20 and 21, the layer 620 of electrically insulating material preferably includes an overlapping element 604 for covering the exposed surface 688 of the straight track portion 684, for at least partially electrically isolating the straight rail segment 697 relative to the supporting material.

As can be seen in FIG. 11, the special track assembly 651 preferably also includes a pair of flangeway formers 606. Two straight track portions (identified in FIG. 11 as 684*a* and 684*b* for convenience) are positioned at a preselected end 608 of the special track segment 602. Each of the straight track portions 684*a*, 684*b* includes an inner side 610 opposite an outer side 612 thereof. The flangeway formers 606 are positionable along the inner sides 610 of the straight track portions 684*a*,

684*b* for at least partially defining grooves 614*a*, 614*b* respectively in which at least parts of the wheels of the train are engageable.

Figure 16:
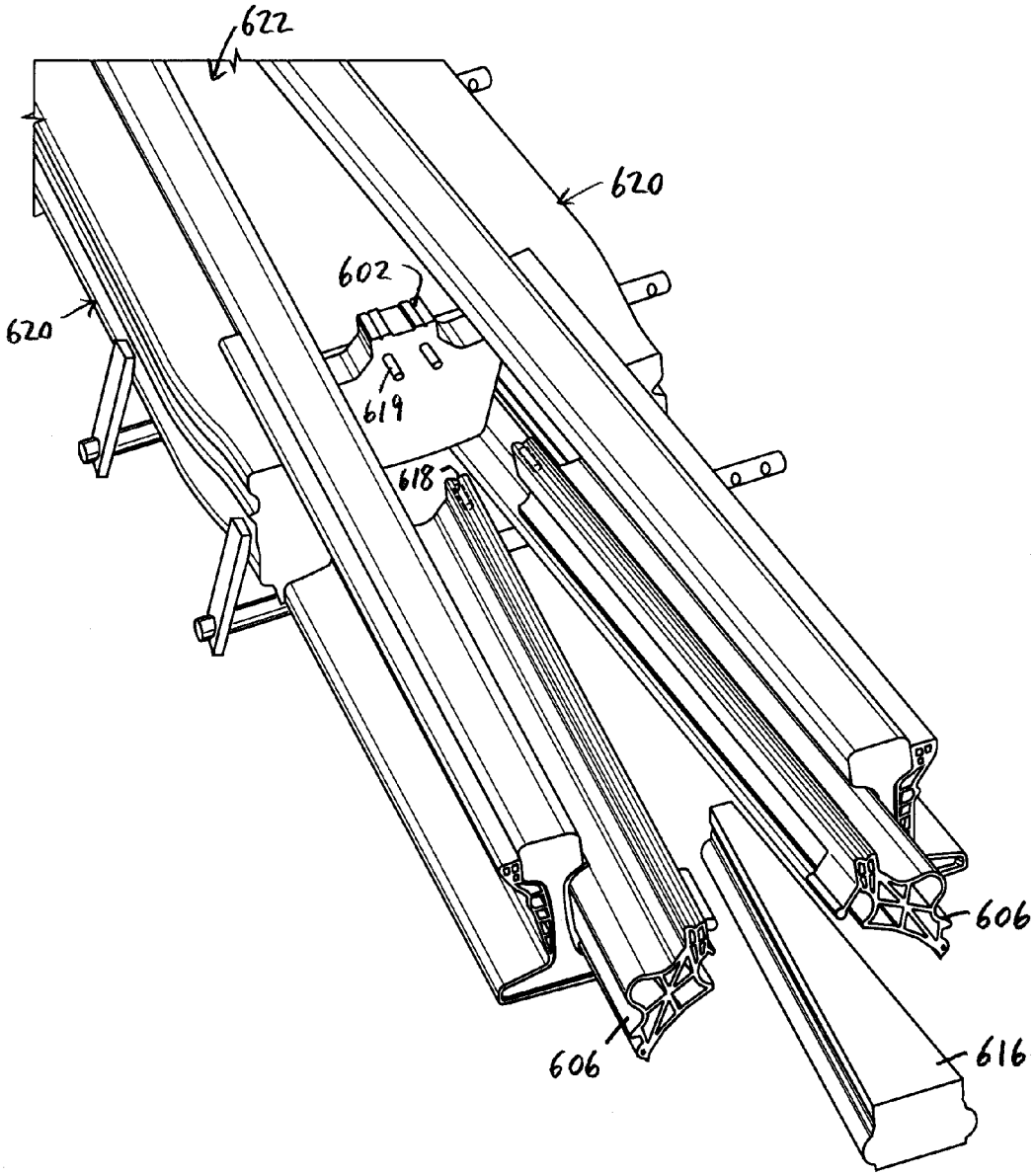
FIG. 16 is a partially exploded view of a portion of the special track assembly of FIG. 15, drawn at a larger scale.

Preferably the flangeway formers 606 are at least partially held in place by an extension part 616 positioned between and engaging the flangeway formers 606 (FIG. 11). In one embodiment, each flangeway former 606 includes one or more holes 618 in which one or more pins 619 projecting from the end portion 602 are receivable, for holding the flangeway former 606 in a predetermined position between the two straight track portions (FIG. 16).

The extension part 616 also serves to fill the gap between the two straight rail portions, up to grade, or approximately up to grade (i.e., to form an upper surface in a predetermined relationship to the upper surface of the special track segment). In the prior art, the gap between the straight rail portions in the vicinity of the special track segment is filled with concrete up to grade. However, because the gap is relatively narrow in the part thereof proximal to the special track segment, concrete positioned in such part tends to break soon after it is laid. This is because concrete, to remain whole and load-bearing, requires a certain minimum amount of mass, i.e., minimum width, thickness, and depth. The extension part 616 preferably is made of any suitable material (e.g., polyurethane) and is adapted to fill the gap from its narrowest part to a point at which concrete may be positioned between the straight track portions.

As can be seen in FIG. 15, the special track assembly 651 preferably includes a number of clamp subassemblies 621. Each clamp subassembly 621 includes first and second engagement arms 623, 628, for engaging the layer 620 of the electrically insulating material. The arms 623, 628 are for urging the layer 620 against oppositely positioned exterior surfaces of the special track segment 622 (FIG. 15). The clamp subassembly 621 preferably also includes a connecting member 629 for connecting the first and second engagement arm 623, 628, to maintain the first and segment engagement arms in engagement with the layer 620 of the electrically insulating material. In use, the clamp subassemblies 621 are intended to ensure that the covering remains adhered to the exterior surfaces while the special track assembly is installed. After the special track assembly is put in position with the clamp subassemblies 621 also in position, additional supporting material (not shown in FIG. 15) is positioned beside the special track assembly, burying the clamp subassemblies. Such supporting material engages the covering.

It will be appreciated by those skilled in the art that the electrically insulating material preferably is also resilient. Any suitable electrically insulating material may be used. For example, the electrically insulating material preferably is rubber.

As indicated above, the special track assembly may be electrically connected to adjacent straight track portions when the special track assembly is installed. This procedure tends to be somewhat time-consuming. As an alternative, straight track portions may be attached to the special track segment, and the straight rail segments and the special track segment may be encapsulated with the resilient material (i.e., to form the covering 620 over the special track segment 622, and the straight rail segments 684). Electrically conductive connections between the special track segment and the straight rail segments preferably are made after the straight rail segments are attached to the special track segment. The subsequent encapsulation of the special track segment and the straight rail segments provides a complete covering of the exterior surfaces which substantially electrically isolates the special track segment and the connected straight rail segments relative to the supporting material. This method provides a special track assembly with selected lengths of straight rail segments already attached to the special track segment, and encapsulated in the resilient and electrically insulating material. This special track assembly is transported to the site, and may be installed relatively quickly, as the connections which need to be made to straight rail segments already in position at the site are with the straight track portions which are included in the special track assembly.

Figure 22:
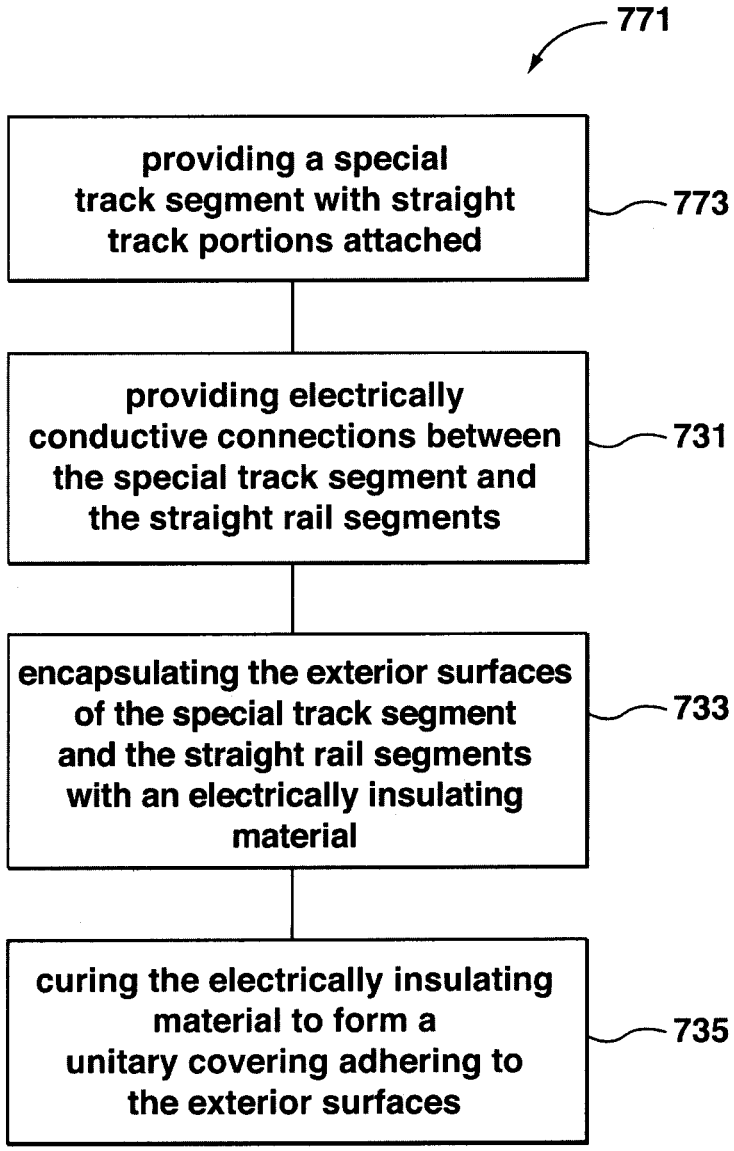
FIG. 22 is a flow chart schematically illustrating another embodiment of a method of the invention.

In one embodiment of a method 771 of the invention of forming a special track assembly including one or more straight track portions, the special track segment is first provided, with one or more straight track portions attached thereto (step 773, FIG. 22). Next, electrically conductive connections between the special track segment and the straight rail segments are provided (step 731). Subsequently, the exterior surfaces of the special track segment and the straight rail segments are encapsulated with an electrically insulating material, for at least partially electrically isolating the special track segment and the straight rail segments relative to the supporting material (step 733). Also, the electrically insulating material is cured, to form a unitary covering adhering to the exterior surfaces (step 735).

Preferably, the electrically insulating material is also resilient. It is also preferred that the resilient and electrically insulating material includes a number of cavities therein. Each such cavity preferably is at least partially defined by a wall portion deflectable for dissipating energy transmitted by movement of one or both of the special track segment and the straight rail segments relative to the supporting material.

Figure 23:
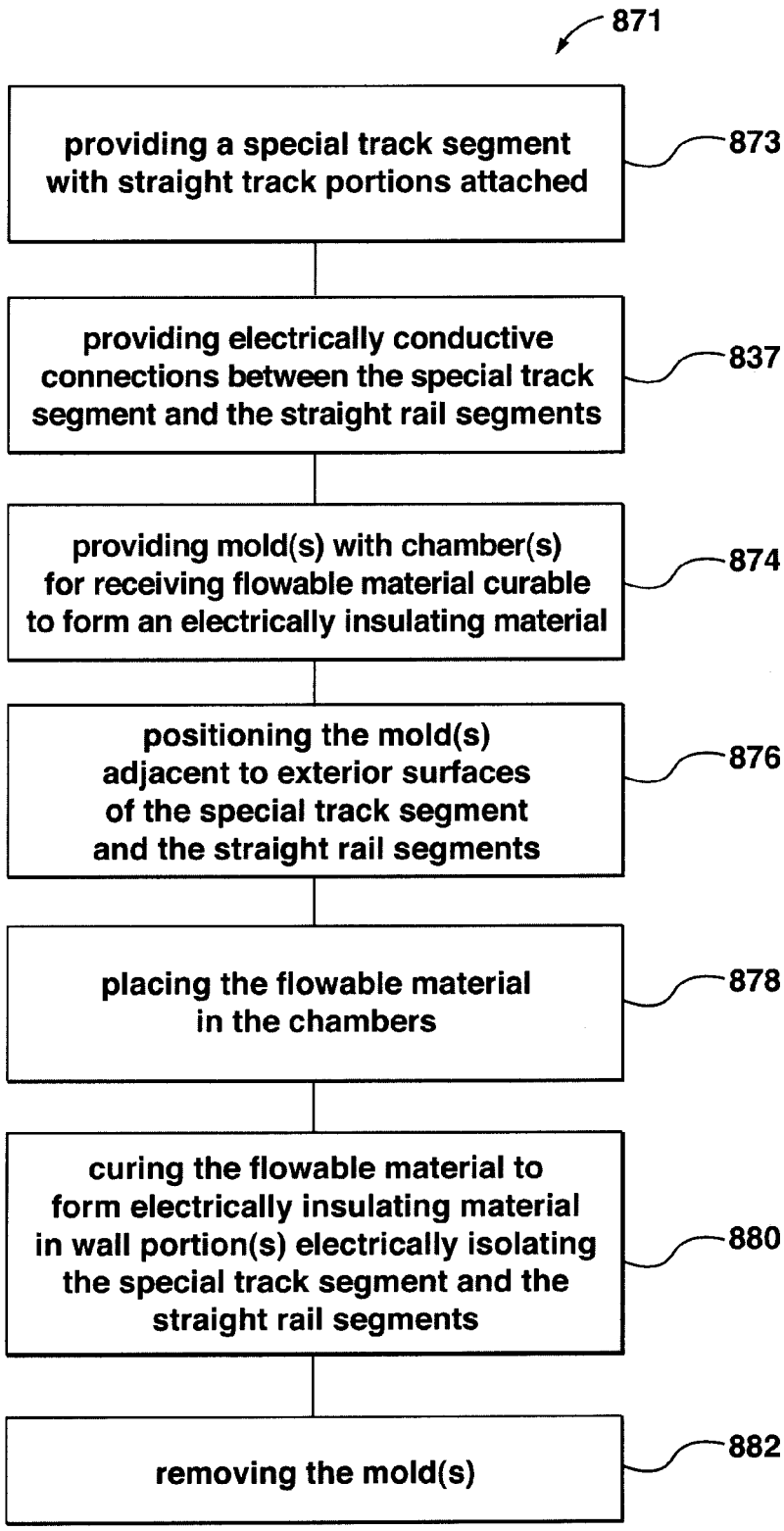
FIG. 23 is a flow chart schematically illustrating another embodiment of a method of the invention.

Another embodiment of a method 871 of the invention is schematically illustrated in FIG. 23. First, the special track segment is provided (step 873). Next, electrically conductive connections are provided between the special track segment and the straight rail segments (step 837). Subsequently, molds are provided with chambers therein for receiving pourable material curable to form an electrically insulating material (step 874). The molds are positioned adjacent to exterior surfaces of the special track segment and the straight track segments (step 876). The pourable material is placed in the chambers (step 878). Next, the pourable material is cured to form a covering made of the electrically insulating material (step 880). The electrically insulating material is configured to form one or more wall portions electrically isolating the special track segment and the straight rail segments relative to the supporting material. Finally, the molds are removed (step 882).

It will be understood that the electrically insulating material preferably is also a first resilient material. For example, a suitable electrically insulating and resilient material is polyurethane. However, as described above, in order for the covering to have suitable resilience and deflection characteristics overall, the covering also preferably includes outer pockets which preferably are also filled with a second resilient material, such a suitable material being any suitable closed-cell foam, e.g., polyurethane foam.

Any element in a claim that does not explicitly state "means for" performing a specific function, or "step for" performing a specific function, is not to be interpreted as a "means" or "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A method of making a special track assembly for supporting a train, the special track assembly being at least partially supportable by supporting material, the method comprising:

(a) providing a special track segment comprising:

at least one rail portion comprising a head for engaging wheels of the train comprising a plurality of top surfaces thereof, a foot securable to the supporting material, and a web connecting the head and the foot;

a body portion connected to said at least one rail portion, the special track segment being at least partially defined by a plurality of exterior surfaces and the top surfaces thereof;

(b) attaching a plurality of ribs comprising a resilient material to the exterior surfaces, adjacent ones of the ribs being spaced apart from each other by predetermined distances to define gaps therebetween respectively;

(c) attaching at least one wall portion of the resilient material to the ribs, for bridging each said gap to at least partially define a plurality of cavities between said adjacent ribs respectively, said at least one wall portion being deflectable for dissipating energy transmitted by movement of the special track segment relative to the supporting material; and (d) curing the ribs and said at least one wall portion, to form the ribs and said at least one wall portion into a unitary covering, including curing the unitary covering to adhere to the exterior surfaces for engagement with the supporting material.

2. The method of claim 1 wherein the special track segment is cast.

3. The method of claim 2 wherein said step (a) further includes casting the special track segment for an intersection.

4. The method of claim 1 wherein the special track segment is an intersection.

5. The method of claim 1 further including the step of encapsulating the foot portion with the unitary covering in said step (d).

6. A method of making a special track assembly for supporting a train, the special track assembly being at least partially supportable by supporting material, the method comprising:

(a) providing a special track segment comprising:

at least one rail portion comprising a head for engaging wheels of the train comprising a plurality of top surfaces thereof, a foot securable to the supporting material, and a web connecting the head and the foot;

a body portion connected to said at least one rail portion, the body portion comprising at least one pocket therein, the special track segment being at least partially defined by a plurality of exterior side surfaces and the top surfaces thereof;

(b) inserting a lightweight filler material having a density substantially less than that of the special track segment in said at least one pocket, to substantially fill said at least one pocket and least partially define an exterior bottom surface of the special track segment;

(c) cleaning the exterior side and bottom surfaces such that a primer is adherable thereto;

(d) applying said primer to the exterior side and bottom surfaces to provide primed exterior surfaces thereon;

(e) applying a layer of adhesive material to the primed exterior surfaces, to provide adhesive-covered exterior surfaces thereon;

(f) applying a plurality of ribs comprising a resilient material to the adhesive-covered exterior surfaces, adjacent ones of the ribs being spaced apart from each other by predetermined distances to define gaps therebetween respectively;

(g) attaching at least one wall portion of the resilient material to the ribs for bridging gaps to at least partially define a plurality of cavities between said adjacent ribs respectively, said at least one wall portion being deflectable for dissipating energy transmitted by movement of the special track segment relative to the supporting material; and (h) curing the ribs and said at least one wall portion, to form the ribs and said at least one wall portion into a unitary covering adhering to the exterior side and bottom surfaces for engagement with the supporting material.

7. A method of forming a resilient jacket for a special track segment for supporting a train, the special track segment comprising at least one rail portion comprising a head for engaging wheels of the train comprising a plurality of top surfaces thereof, a foot securable to supporting material, and a web connecting the head and the foot, and a body portion connected to said at least one rail portion, the special track segment being at least partially defined by a plurality of exterior surfaces and the top surfaces thereof, the special track being at least partially supportable by supporting material, the method comprising:

(a) cleaning the exterior surfaces such that a primer is adherable thereto;

(b) applying said primer to the exterior surfaces to provide primed exterior surfaces thereon;

(c) applying a layer of adhesive material to the primed exterior surfaces, to provide adhesive-covered exterior surfaces thereon;

(d) applying a layer of resilient material to the adhesive-covered exterior surfaces, the layer of resilient material comprising a plurality of cavities therein, each said cavity being at least partially defined by at least one wall portion deflectable for dissipating energy transmitted by movement of the special track segment relative to the supporting material; and (e) curing the layer of resilient material, to form the layer into a unitary covering adhering to the exterior surfaces for engagement with the supporting material.

8. A method according to claim 7 in which the resilient material is electrically insulating, for electrically isolating the special track segment relative to the supporting material.

9. A method of making a special track assembly for supporting a train, the special track assembly being at least partially supportable by supporting material, the method comprising:

(a) providing a special track segment comprising:

at least one rail portion comprising a head for engaging wheels of the train comprising a plurality of top surfaces thereof, a foot securable to the supporting material, and a web connecting the head and the foot;

a body portion connected to said at least one rail portion, the special track segment being at least partially defined by a plurality of exterior surfaces and the top surfaces thereof;

(b) providing at least one mold comprising at least one chamber for receiving a pourable material therein curable to form a first resilient material;

(c) forming a plurality of outer pockets comprising a second resilient material located in predetermined positions respectively relative to the exterior surfaces, the outer pockets being located at least partially within said at least one chamber;

(d) positioning said at least one mold adjacent to the exterior surfaces;

(e) placing the pourable material in said at least one chamber to form at least one wall portion comprising the first resilient material at least partially enveloping the outer pockets;

(f) curing the pourable material to form the first resilient material therefrom adhering to the exterior surfaces, said at least one wall portion and the outer pockets comprising a unitary covering which is deflectable for dissipating energy transmitted by movement of the special track segment relative to the supporting material; and (g) removing said at least one mold.

10. A special track assembly for supporting a train, the special track assembly being at least partially supportable by a supporting material and adapted for connection with at least one straight track portion comprising a straight rail segment and a boot comprising electrically insulating material and partially covering the straight rail segment to define at least one exposed surface thereof, the special track assembly comprising:

a special track segment comprising:

at least one rail portion comprising a head for engagement with wheels of the train comprising a plurality of top surfaces thereof, a foot securable to the supporting material, and a web connecting the head and the foot;

a body portion connected to said at least one rail portion;

the special track segment being at least partially defined by a plurality of exterior surfaces and the top surfaces thereof;

said at least one rail portion being substantially alignable with said at least one straight track portion upon respective ends of said at least one rail portion and said at least one straight track portion being positioned to abut each other;

a layer of an electrically insulating material attached to the exterior surfaces for substantially electrically isolating the special track segment relative to the supporting material, the layer having been cured to form a unitary covering adhering to the exterior surfaces;

a connecting element for electrically connecting the special track segment and the straight rail segment; and a connecting portion comprising the electrically insulating material for substantially electrically isolating at least the connecting element and said at least one exposed surface relative to the supporting material.

11. A special track assembly according to claim 10 in which the connecting portion and the connecting element are molded together to form a connector for electrically isolating at least the connecting element and said at least one exposed surface.

12. A special track assembly according to claim 10 additionally comprising an end portion comprising the electrically insulating material for at least partially electrically isolating the special track segment relative to the supporting material, the end portion being attachable to the body portion of the special track segment.

13. A special track assembly according to claim 12 in which the layer of electrically insulating material comprises at least one overlapping element for covering said at least one exposed surface of the straight rail segment, for at least partially electrically isolating said at least one straight track portion relative to the supporting material.

14. A special track assembly according to claim 12 adapted for receiving at least two straight track portions at a preselected end of the special track segment, each of said at least two straight track portions comprising an inner side opposite an outer side thereof, the special track assembly comprising:

a pair of flangeway formers positionable along the inner sides of said at least two straight track portions, for at least partially defining grooves respectively in which at least parts of the wheels of the train are engageable.

15. A special track assembly according to claim 14 in which the flangeway formers are at least partially held in place by an extension part positioned between and engaging the flangeway formers.

16. A special track assembly according to claim 15 in which each said flangeway former comprises at least one hole in which at least one pin projecting from the end portion is receivable, for holding each said flangeway former in a predetermined position between the two straight track portions.

17. The special track assembly of claim 10 wherein the at least one rail portion includes two intersecting rail portions.

18. The special track assembly of claim 17 wherein the special track segment is a cast special track segment including the intersection of the two rail portions.

19. A method of forming a special track assembly for supporting a train, the special track assembly being at least partially supportable by a supporting material and including at least one straight track portion comprising a straight rail segment, the method comprising:

(a) providing a special track segment comprising:

at least one rail portion comprising a head for engagement with wheels of the train comprising a plurality of top surfaces thereof, a foot securable to the supporting material, and a web connecting the head and the foot;

a body portion connected to said at least one rail portion, the special track segment being at least partially defined by a plurality of exterior surfaces and the top surfaces thereof;

(b) electrically connecting the straight rail segment with the special track segment such that said at least one rail portion is substantially aligned with said at least one straight track portion, said at least one straight track portion being at least partially defined by a plurality of top surfaces thereof and a plurality of exterior surfaces thereof;

(c) encapsulating the respective exterior surfaces of the special track segment and said at least one straight track portion with an electrically insulating material, for substantially electrically isolating the special track segment and the straight rail segment relative to the supporting material; and (d) curing the electrically insulating material to form the electrically insulating material into a unitary covering adhering to the exterior surfaces for engagement with the supporting material.

20. A method according to claim 19 in which the electrically insulating material is resilient and additionally comprises a plurality of cavities therein, each said cavity being at least partially defined by at least one wall portion deflectable for dissipating energy transmitted by movement of at least one of the special track segment and the straight rail segment relative to the supporting material.

21. A method of forming a special track assembly for supporting a train, the special track assembly being at least partially supportable by a supporting material and including at least one straight track portion comprising a straight rail segment, the method comprising:

(a) providing a special track segment comprising:

at least one rail portion comprising a head for engagement with wheels of the train comprising a plurality of top surfaces thereof, a foot securable to the supporting material, and a web connecting the head and the foot;

a body portion connected to said at least one rail portion, the special track segment being at least partially defined by a plurality of exterior surfaces and the top surfaces thereof;

(b) electrically connecting the straight rail segment with the special track segment such that said at least one rail portion is substantially aligned with said at least one straight track portion, the straight rail segment being at least partially defined by a plurality of top surfaces thereof and a plurality of exterior surfaces thereof;

(c) providing at least one mold comprising at least one chamber for receiving a pourable material curable to form an electrically insulating material, said at least one chamber being configured to form at least one wall portion substantially electrically isolating the special track segment and the straight rail segment relative to the supporting material;

(d) positioning said at least one mold adjacent to the exterior surfaces;

(e) placing the pourable material in said at least one chamber;

(f) curing the pourable material to form the electrically insulating material therefrom into a unitary covering adhering to the exterior surfaces for engagement with the supporting material; and (g) removing said at least one mold.

22. A special track assembly for supporting a train, the special track assembly being at least partially supportable by a supporting material, the special track assembly comprising:

a special track segment comprising:

at least one rail portion comprising a head for engagement with wheels of the train comprising a plurality of top surfaces thereof, a foot securable to the supporting material, and a web connecting the head and the foot;

a body portion connected to said at least one rail portion;

the special track segment being at least partially defined by a plurality of exterior surfaces and the top surfaces thereof;

a unitary covering comprising a layer of a first resilient material cured to adhere to the exterior surfaces; and the covering additionally comprising a plurality of outer pockets in which a second resilient material is positioned, the outer pockets being configured such that the covering is deflectable for dissipating energy transmitted by movement of the special track segment relative to the supporting material.

* * * * *